US005499086A

United States Patent [19]

Matsuno et al.

[11] Patent Number: 5,499,086

[45] Date of Patent: Mar. 12, 1996

[54] BELT TYPE TRANSFER DEVICE FOR ELECTROPHOTOGRAPHIC APPARATUS

[75] Inventors: Junichi Matsuno, Toride; Shigeru Obata, Ishioka; Yasuo Takuma, Hitachi; Masato Miwa; Kazuo Uno, both of Katsuta, all of Japan

[73] Assignees: Hitachi, Ltd.; Hitachi Koki Co., Ltd., both of Tokyo, Japan

[21] Appl. No.: 91,181

[22] Filed: Jul. 13, 1993

[30] Foreign Application Priority Data

Jul. 17, 1992 [JP] Japan ..... 4-190469
Oct. 5, 1992 [JP] Japan ..... 4-265772

[51] Int. Cl.[6] ..... G03G 15/16

[52] U.S. Cl. ..... 355/274; 355/309

[58] Field of Search ..... 355/271, 273, 355/274, 275, 276, 281, 219, 221, 309; 428/323, 325, 328, 403

[56] References Cited

U.S. PATENT DOCUMENTS

| | | | |
|---|---|---|---|
| 4,864,363 | 9/1989 | Shinada | 355/221 X |
| 4,984,024 | 1/1991 | Ohkaji et al. | 355/273 |
| 5,144,383 | 9/1992 | Murano et al. | 355/274 |
| 5,250,999 | 10/1993 | Kimura et al. | 355/273 X |
| 5,268,724 | 12/1993 | Koizumi et al. | 355/274 |
| 5,283,116 | 2/1994 | Tomari et al. | 428/323 |
| 5,291,253 | 3/1994 | Kumasaka et al. | 355/275 |

FOREIGN PATENT DOCUMENTS

| | | | |
|---|---|---|---|
| 4039158 | 7/1990 | Germany . | |
| 4035733 | 11/1990 | Germany . | |
| 62-161157 | 7/1987 | Japan . | |
| 2-095668 | 4/1990 | Japan . | |
| 4-51178 | 6/1990 | Japan . | |
| 0399500 | 11/1990 | Japan | 355/274 |
| 3-238483 | 10/1991 | Japan . | |

*Primary Examiner*—A. T. Grimley
*Assistant Examiner*—Shuk Y. Lee
*Attorney, Agent, or Firm*—Antonelli, Terry, Stout & Kraus

[57] ABSTRACT

A belt-type transfer device which includes an endless belt rotating in contact with a photosensitive drum, with the belt being electrically charged by a corona discharger in a region of contact between the belt and the drum. A plate is provided for shielding the belt from the corona discharging in a vicinity of an outlet of the contact area to reduce electrostatic traction forces between the drum and the sheet in a vicinity of the outlet. The corona discharger may be located near an inlet of the region of contact with respect to a center thereof or a dielectric or electrically conductive film may be provided on an inner surface of the corona discharger on the contact area outlet side to increase the electrical charge of the belt at the inlet and the central portion of the region of contact. A control system detects an electric resistance value of the sheet and changes the corona discharging intensity in accordance with a detected value to stabilize an electrical charge of the belt or, a control system may be provided for slightly lowering a moving speed of the sheet as compared with a rotational speed of the drum at an outlet of the region of contact. Surface roughness of the belt is 5 μm or less and the sheet delivery guides are provided having a volume resistivity of $10^{11}$ Ωcm or less, which reduces electrical charge caused on the sheet due to frictional contact.

22 Claims, 16 Drawing Sheets

BELT TYPE TRANSFER DEVICE FOR ELECTROPHOTOGRAPHIC APPARATUS

BACKGROUND OF THE INVENTION

The present invention relates to a belt type transfer device for transferring a toner image on a photosensitive body to a recording medium, for use in an electrophotographic apparatus such as a copier or a printer, and more particularly, to a highly reliable belt-type transfer device having a high transferring operation efficiency and an improved separating efficiency of a recording medium from a photosensitive body, and to an electrophotographic apparatus which improves a performance of a belt-type transfer device.

In a belt type transfer recording medium sheet (sheet) is delivered to a transferring region by an endless belt of an elastic material which is dielectric or has a high electric resistance, and a toner image on a photosensitive body is electrostatically transferred to the sheet. More specifically, the endless belt is rotatably driven and charged by a corona electric charger. The sheet is electrostatically attracted by the belt due to the charged potential so as to be conveyed to the photosensitive body in the transferring region. The photosensitive body carries an electrostatic latent image, and the electrostatic latent image is developed with a toner. In the transferring region, the belt brings the sheet into contact with the photosensitive body. The toner image is electrostatically transferred to the sheet by migration of the charged potential of the belt, that is, an inflow current toward the belt, thus performing the image transferring.

In the transfer device utilizing the endless belt, therefore, the sheet is delivered so as to contact with the belt and the photosensitive body. Previously, the speeds of the belt, the photosensitive body and the sheet where equalized, and the belt was sufficiently charged, in order to ensure attraction of the sheet and good image transfer. During image transfer, a current of 10 μA to 100 μA was caused to flow through the belt to transfer the toner image to the sheet.

After transferring the toner image, however, the sheet sometimes fails to separate from the photosensitive body and adheres to the outer periphery of the photosensitive body because of insufficient contact between the sheet and the belt and the adhesion of the sheet to the photosensitive body, results in a malfunction. Further, the endless belt is electrically charged by friction caused between the belt and the photosensitive body or the sheet during operation, so that the potential of the belt is unstable. In such a state, if the transferring is performed, the electrostatic attraction force necessary for delivery of the sheet is reduced. As a result, the sheet is attracted by the photosensitive body thereby causing a failure of the sheet separation and the image transferring.

To prevent a sheet from adhering to an outer periphery of a photosensitive body in a belt-type transfer device, Japanese Patent Unexamined Publication No. 62-161157 proposes providing an electric charger exclusively used for attraction of the sheet. Moreover, Japanese Patent Unexamined Publication No. 2-95668 proposes a device in which a sheet is curled in a direction of separation of the sheet from a photosensitive drum just entering into before an image transfer section. Additionally, in Japanese Patent Unexamined Publication No. 3-238483, for the purpose of sheet separation, the electric charge of a belt is removed after image transferring.

SUMMARY OF THE INVENTION

The present invention has an object of providing a belt-type transfer device which ensures a good sheet separation from a photosensitive body and which exhibits a high transferring efficiency.

Another object of the invention is to provide a belt-type transfer device in which an electric potential of a belt is stable, image transferring efficiency is high, and sheet separation efficiency is satisfactory.

Still another object of the invention is to provide an electrophotographic apparatus for improving performance of a belt-type transfer device.

In order to ensure close contact of a recording sheet to a belt and transfer of a toner image to the sheet, it is necessary to sufficiently electrically charge the belt. However, if the belt is charged uniformly over an entire area of contact between the belt and the photosensitive body, an electrostatic attraction force between the photosensitive body and the sheet in the vicinity of an outlet of the contact area is maintained equally to that at the inlet and the central portion of the contact area. As a result, the sheet adheres to an outer periphery of the photosensitive body. When the sheet is forcibly separated from the photosensitive body, the toner image on the sheet is, at times, distorted due to discharge when the separation occurs.

The invention aims at both good transferring of the toner image and sure separation of the sheet from the photosensitive body by weakening the electric charge of the belt in the vicinity of the outlet of the contact area between the photosensitive body and the belt.

According to one aspect of the invention, a belt-type transfer device for an electrophotographic apparatus in which a toner image is formed on a photosensitive body and the toner image is electro-statically transferred and adhered to a recording medium, is provided which includes an endless belt formed of an elastic material having a high electrical resistance and means for rotatably driving the belt, with the belt being driven in contact with the photosensitive body over a certain distance. Means are provided for electrically charging the belt in a region of contact between the belt and the photosensitive body, with the belt electrostatically attracting the recording medium, due to an electric charge by the electrically charging means, and conveying the recording medium to the contact region to transfer the toner image on the photosensitive body to the recording medium. Means are also provided for reducing the electric charge by the electrically charging means in the vicinity of a terminal end of the contact region.

The electric charge reducing means may be a shielding plate interposed between the photosensitive body and the belt in the vicinity of an outlet of the contact region, or may comprise relocating of the charging means which is set nearer an inlet of the contact area.

Thus providing the electric charge reducing means by addition of the shielding plate or by optimizing the location of the charging means, the electrostatic attraction force between the photosensitive body and the recording sheet is reduced in the vicinity of the terminal end or outlet of the contact region so that the separation of the sheet can surely be achieved.

In addition to the electric charge reducing means, it is preferable to the above end to provide means for increasing the electric charge at the inlet and the central portion of the contact area.

The transfer belt is electrically charged by friction between the belt and the photosensitive body and the recording sheet during printing, so that the electrical potential of the belt becomes unstable. When transferring is performed in such a state, an electrostatic attraction force necessary for delivery of the sheet is reduced and the sheet is unfavorably adheres to an outer periphery of the photosensitive body. In the above-described belt-type transfer device, it is preferable to earth or ground members in contact with the belt to stabilize the electrical potential of the belt thereby preventing adhesion of the sheet around the photosensitive body and distortion of a transferred image.

Further, even if the electric charging means electrify uniformly, the electric charge of the sheet and the belt changes in dependence upon the kind or a moisture content of the recording sheet. Accordingly, it is preferable to provide means for maintaining a current flowing through the belt by the electrical charging means at a constant value to stabilize the electric charge. Such belt-type transfer device is suitable for duplex printing in which a toner image is first transferred to one side of a recording sheet, and thereafter another toner image is transferred to the other side of the sheet.

In the transferring region, unless the moving speeds of the photosensitive body, the recording sheet and the belt are set appropriately, a motion of a leading edge of the recording sheet becomes unstable, so that the sheet adheres to the outer periphery of the photosensitive body.

The invention further aims at determining the moving speeds of the photosensitive body, the recording sheet and the belt appropriately to positively control the motion of the leading edge of the recording sheet at the outlet of the contact area between the belt and the photosensitive body, thereby surely separating the recording sheet from the photosensitive body.

According to another aspect of the invention, a belt-type transfer device for an electrophotographic apparatus in which a toner image is formed on a rotatable photosensitive body and the toner image is electro-statically transferred and adhered to a recording medium is provided which includes an endless belt formed of a dielectric elastic material and means for rotatably driving the belt with the belt being moved through a transfer section and being in contact with the photosensitive body over a certain distance at the transfer section. A corona discharging means electrically charges the belt at the transfer section, with the belt electrostatically attracting the recording medium due to an electric charge by the corona discharging means and delivering recording medium to the transfer section so that the toner image on the photosensitive body is transferred to the recording medium. Means are provided for reducing a moving speed of the recording medium to an extent slower than a rotating speed of the photosensitive body.

Preferably, that the speed reducing means decrease the speed of the recording medium by 0.5% or less of the rotating speed of the photosensitive body. Also, preferably speed of the recording medium is reduced at least when the leading edge of the recording medium passes the transfer section.

When the recording sheet is moved at a speed than that of the photosensitive body by the speed reducing means, a shearing force or a force for making divergence or slippage between the sheet and the photosensitive body acts thereon, so that the leading edge of the sheet is mechanically bent or tends to deform toward the belt. As a result, the sheet leading edge is surely attracted to the belt, which prevents the adhesion of the sheet around the photosensitive body.

It is preferable to provide the speed reducing means also in the belt-type transfer device according to the first aspect of the invention.

It is preferable that surface roughness (Rmax) of the endless belt is 5 μm or less. When the surface roughness of the belt is large, discharge is caused in fine gaps between the belt and the recording sheet during electrical charging of the belt. And, the electrostatic attraction force between the belt and the recording sheet is accordingly reduced.

In order to stabilize the electric charge of the recording sheet, it is desirable that the electric charge of the recording sheet delivered to the transfer section is as minimal as possible. The sheet is, however, electrically charged due to its frictional contact with delivery guides during transportation of the sheet to the transfer belt. Particularly, in case of duplex printing, because a moisture content of the recording sheet is greatly decreased due to heating by a fixing device at the time of the first printing, the sheet being delivered for a second transferring is largely charged when contacting with the delivery guides.

The invention aims at decreasing the electric charge of the recording sheet, which is caused by its frictional contact with the delivery guides, to ensure a stable transferring operation of a high quality image in the belt-type transfer device.

According to still another aspect of the invention, an electrophotographic apparatus is provided which comprises: a rotatable photosensitive body, means for forming an electrostatic latent image on the photosensitive body, a developing device for visualizing the electrostatic latent image on the photosensitive body with a toner, a belt-type transfer device, and delivery means for feeding recording mediums to a transfer section. The belt-type transfer device includes, an endless belt; means for rotatably the belt in contact with the photosensitive body, and a corona discharger for electrically charging the belt in a region of contact between the belt and the photosensitive body. The belt electrostatically attracts each recording medium due to an electric charge by the corona discharger to convey recording medium to the contact region, thereby transferring the toner image on the photosensitive body to the recording medium. The delivery means includes at least one delivery guide provided along a path of movement of the recording medium. The guide has a volume resistivity of $10^{11}$ Ωcm or less.

The delivery guide reduces the positive electric charge of the recording sheet due to its frictional contact with the guide and enables a stable transferring operation of a high-quality image to be realized.

DESCRIPTION OF THE EMBODIMENTS

Figure 1:
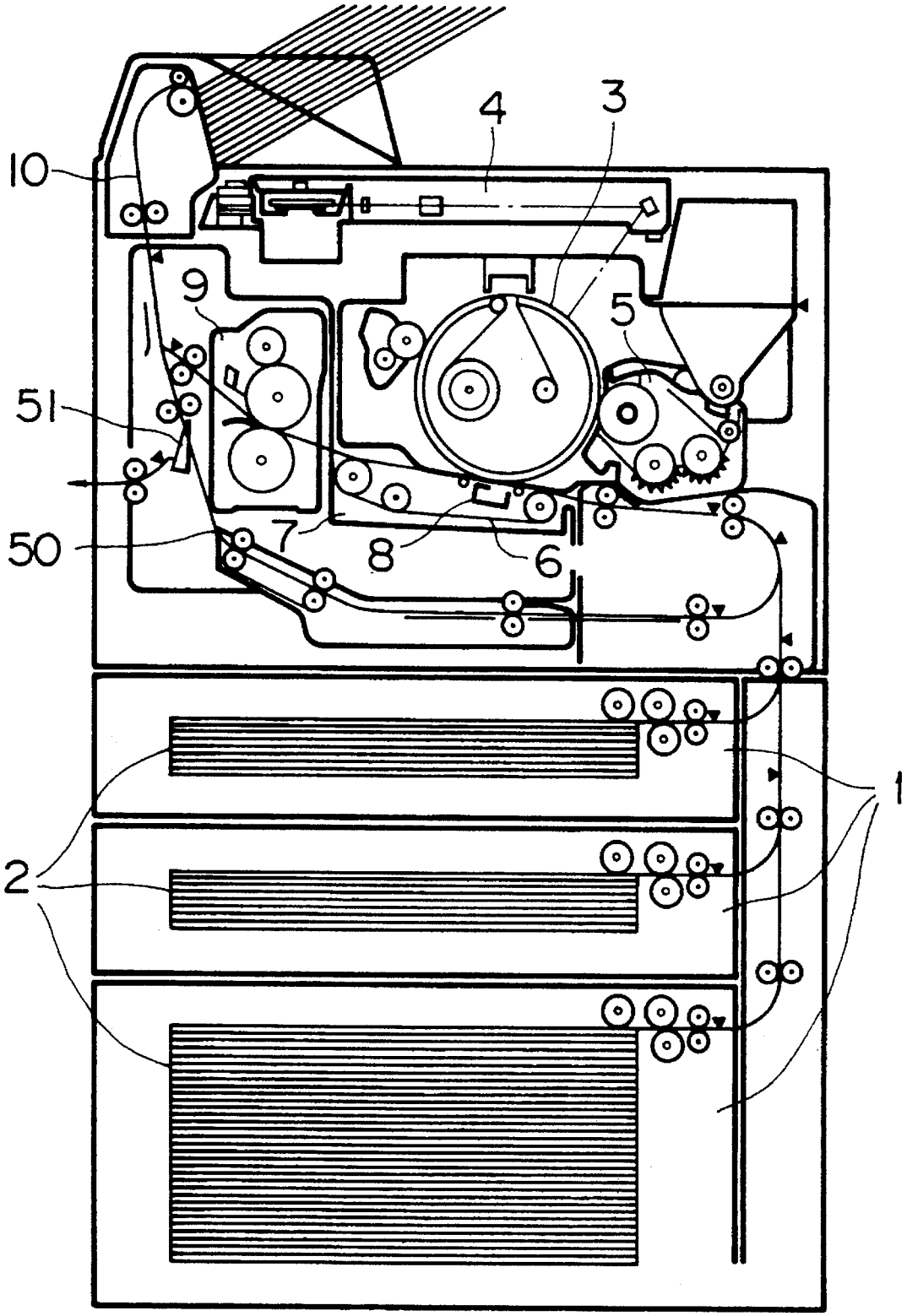
FIG. 1 is a schematic view of an electrophotographic apparatus, for example, a printer, which has a belt-type transfer device according to an embodiment of one aspect of the invention.

Referring now to the drawings wherein like reference numerals are used throughout the various views to designate like parts, and, more particularly, to FIG. 1, according to this Figure, the printer includes three hoppers 1 at a lower portion thereof with a plurality of sheets 2, serving as recording mediums being stored in the respective hoppers 1. The sheets 2 in each hopper are individually separated and delivered to an image transferring region. A drum 3, serving as a photosensitive body, is rotatably provided in the image transferring region. An optical system 4 forms an electrostatic latent image on a surface of the photosensitive drum 3, with developing equipment 5 visualizing the electrostatic latent image on the photosensitive drum 3 with a toner. The developed toner image is transferred from the photosensitive drum 3 to the sheet 2 by a belt type transfer device 7.

The transfer device 7 includes an endless belt 6, of an elastic material having a high electric resistance, and a corona electric charger 8. The belt 6 is located beneath the photosensitive drum 3 so that the belt 6 rotates in contact with the drum 3. The corona electric charger 8 is disposed inside a closed loop formed by the belt 6. The corona electric charger 8 electrifies the belt 6, and the toner image is transferred from photosensitive drum 3 to the sheet 2 by the electrification charge. Thereafter, the sheet 2 is fed to a fixing device 9 by which the toner image is fixed on the sheet.

A direction of delivery of the sheet 2, after image fixation, is reversed at a switchback section 10. The sheet 2 is then delivered to a stacker (not shown) or fed to a delivery passage 50 for D-face to be printed on its rear side. A gate 51 is provided in the sheet transport path to be selectively pivoted for changing the direction of transport of the sheet.

In the above-described printer, the hoppers 1, a mechanism for separating and transporting the sheets 2, and various component parts such as the photosensitive drum 3, the optical system 4, the developing equipment 5 and the fixing device 9 may be of a conventional construction.

Figure 2:
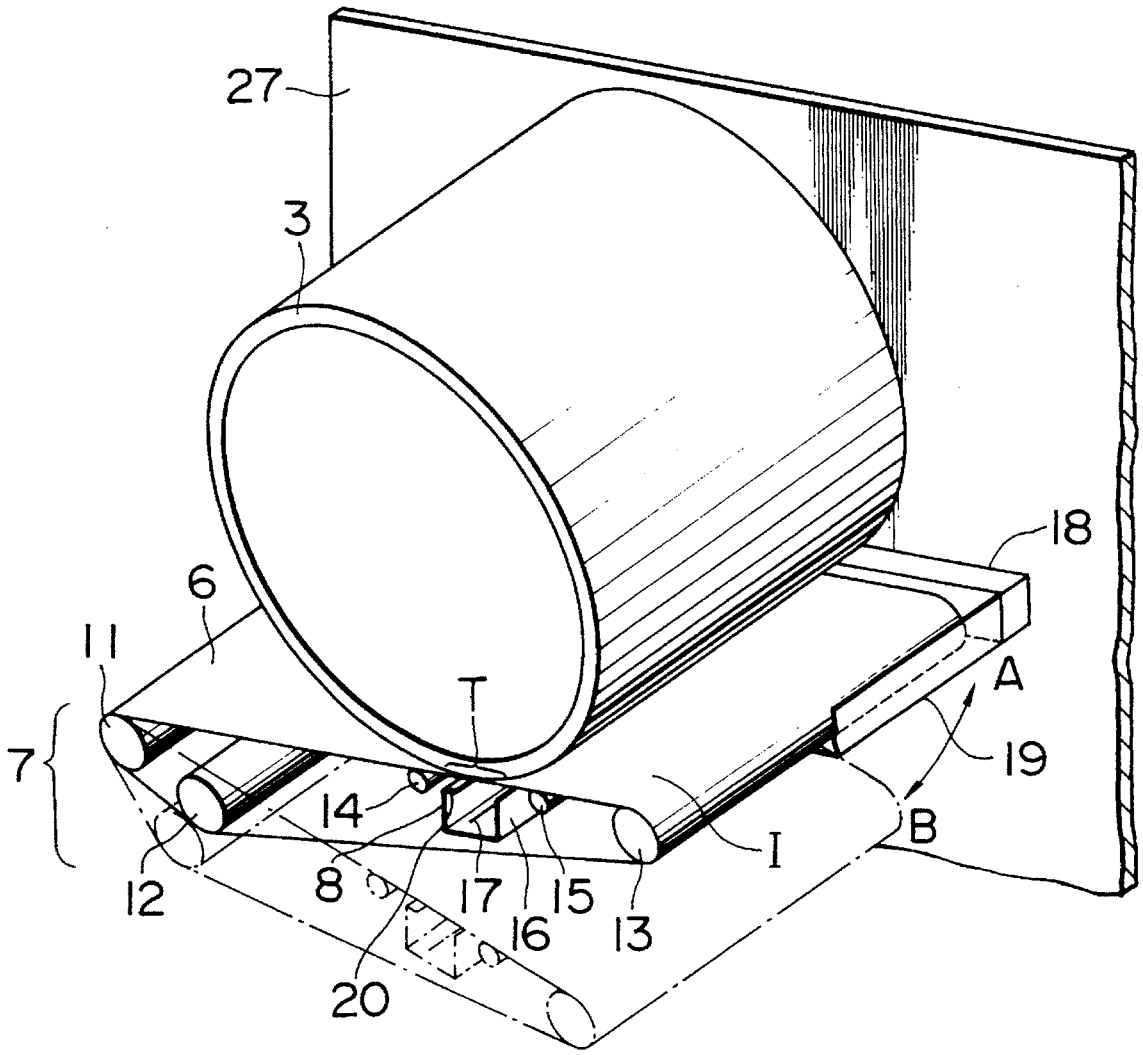
FIG. 2 is a perspective view, on an enlarged scale, the belt-type transfer device of the invention and associated portions.

As shown in FIG. 2, the photosensitive drum 3 is supported by a side plate 27 in the printer, with the photosensitive drum being rotated by a drive source (not shown). The transfer device 7 is arranged in such a manner that an inlet side I of the device leading to a transfer section T is swingable between positions A and B around a shaft of a driving pulley 11 for the belt 6. A stand-by condition of the device 7, in which the inlet side I of the transfer device 7 has been lowered to the position B, is shown in FIG. 2 by a dash and dot line. The shaft of the driving pulley 11 is rotatably supported by the side plate 27. The swinging movement of the transfer device 7 is realized by a mechanism which is not illustrated in the drawings.

Figure 7:
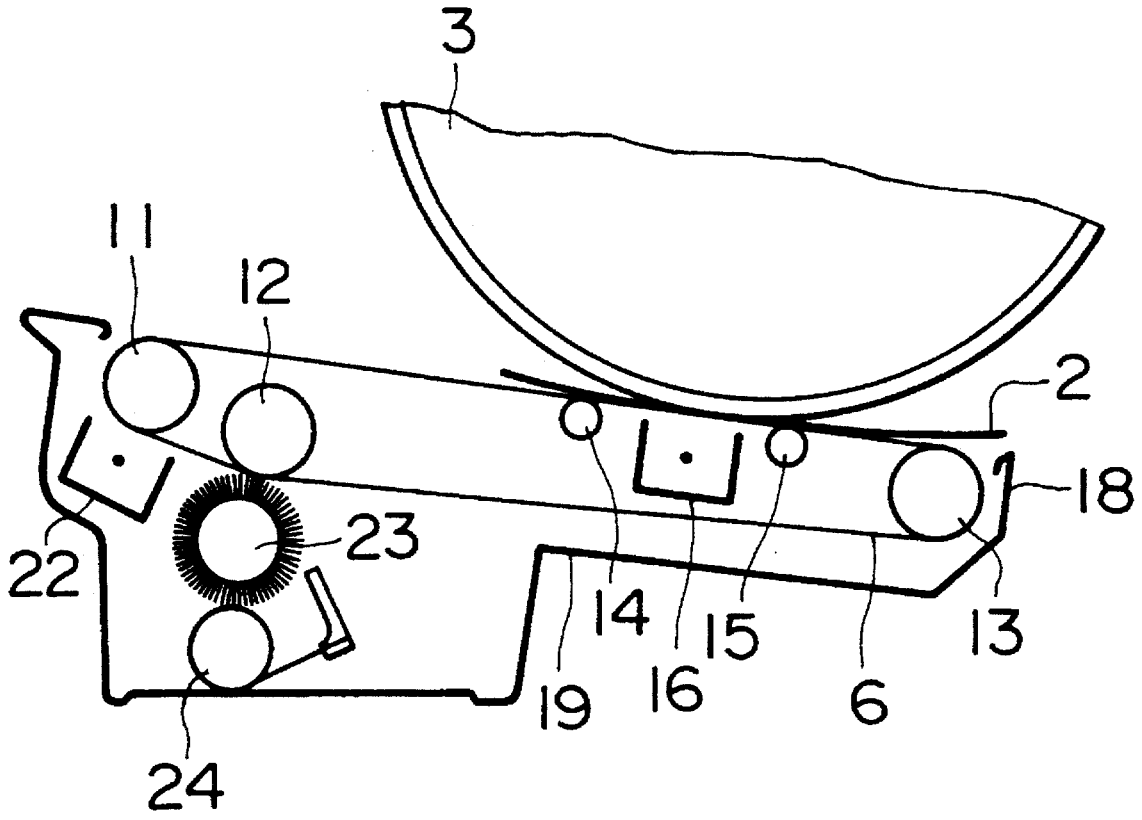
FIG. 7 is a schematic view of the belt-type transfer device shown in FIG. 2.

The belt-type transfer device 7 comprises a unit side plate 18 and a bottom plate 19 which form a casing of the device, the driving pulley 11, a follower pulley 12, an inlet pulley 13, the endless belt 6, the corona electric charger 8, an auxiliary shaft 15 at the inlet of the transfer section, an auxiliary shaft 14 at the outlet of the transfer section, and a cleaning mechanism which is shown in FIG. 7.

The driving pulley 11 is rotatably supported by the side plate 18 in addition to the side plate 27. Drive force for the driving pulley 11 is supplied from a power source (not shown) which may be provided on the side plate 27 or a printer main body. The inlet pulley 13 and the follower pulley 12 are respectively rotatably supported by the side plate 18. These pulleys are situated at certain distances from the driving pulley 1. The belt 6 is wound around the pulleys 11, 12, 13, and is rotated under tension.

The inlet and outlet auxiliary shafts 15 and 14 are rotatably attached to the side plate 18. The shafts 15, 14 serve to ensure a mechanical contact pressure between the belt 6 and the photosensitive drum 3 at the transfer section T. Alternatively, the shafts 14 and 15 may be fixedly mounted on the side plate 18.

The corona electric charger 8 is attached on the side plate 18 to confront the transfer section T with the belt 6 being interposed therebetween. The charger 8 includes an electrically conductive corona wire 17 which extends in a longitudinal direction of the drum 3, and a metal can 16 which surrounds the wire and opens toward the transfer section T. The can 16 is grounded. The side plate 18 may be formed of an electrically conductive material to perform the grounding of the the can via the side plate 18. Alternatively, the side plate 18 may be formed of an insulating material, and an electrically conductive coating material may be applied on a surface of the side plate 18 to make it conductive, thereby grounding the can 16 through the side plate 18.

Electrical connection between the respective component parts, and a state of the transfer section will now be explained with reference to FIGS. 3 and 4.

Figure 3:
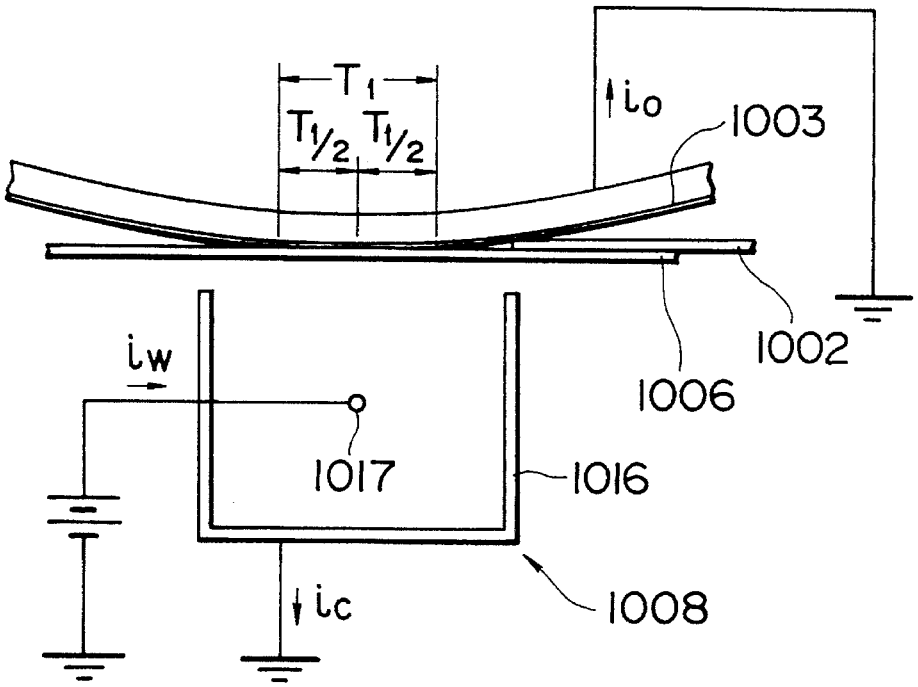
FIG. 3 is a schematic view of a transfer section of the belt-type transfer device of the present invention in a stationary state.

In FIG. 3, the photosensitive drum 1003 and the belt 1006 are in their stationary condition. The corona electric charger 1008 is disposed so that the wire 1017 is located substantially at a center of the transfer section having a width $T_1$.

The wire 1017 is connected to a high-voltage electric power source, and is applied with a positive voltage of several kVs to make an electrical discharge. With this discharge, positive electric charge is imparted to the belt 1006 through an opening of the can 1016 of the corona electric charger. The photosensitive drum 1003 is grounded, and accordingly, migration of the electric charge occurs between the belt 1006 and the drum 1003. As a result, a current $i_o$ flows. A current $i_w$ to the wire 1017 of the charger 8 is represented by a sum of the current $i_o$ and a current $i_c$ flowing to the can 1016.

Figure 4:
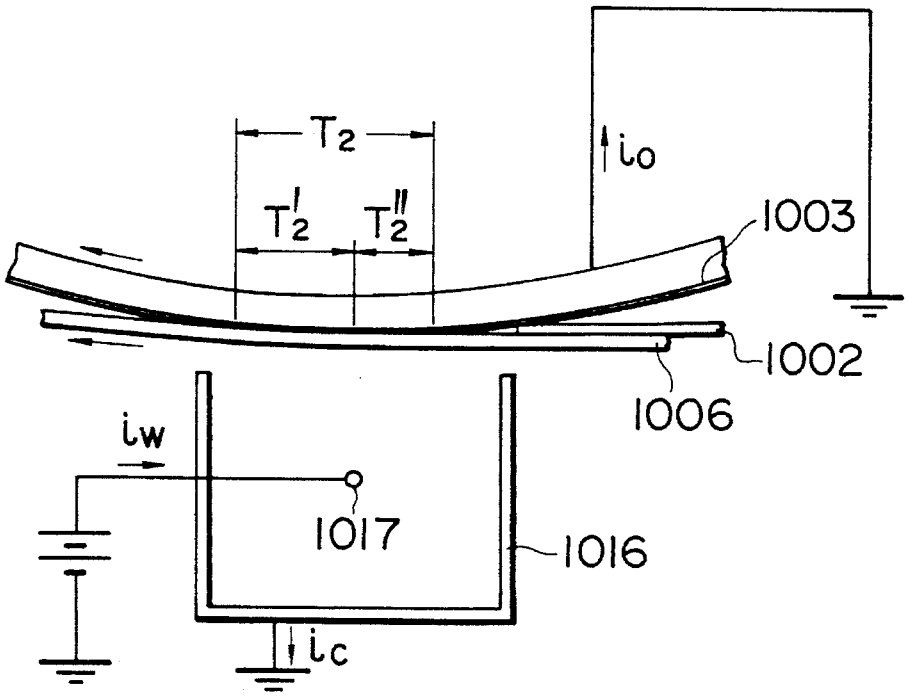
FIG. 4 is a schematic view of a transfer section of the belt-type transfer device of FIG. 3 in an operational state.

As shown in FIG. 4, however, due to an electrostatic attraction force generated during operation of the printer, the width of the transfer section is increased to $T_2$, and the transfer section is shifted in the direction toward the outlet thereof. More specifically, a width $T'_2$ on the outlet side of the transfer section with respect to the wire 1017 and a width $T''_2$ on the inlet side are in a relationship of $T'_2>T''_2$.

At the outlet side of the transfer section, a gap between the belt 1006 and the drum 1003 gradually increases from their state of being in contact with each other. Under such a condition that the transfer section is shifted with respect to the corona wire 1017, when the necessary current $i_o$ for transferring the toner image is supplied, electrical discharge sometimes occurs in a minute gap between the sheet 1002 and the belt 1006. In such a case, the electrostatic attraction force between the sheet 1002 and the belt 1006 is weakened. As a result, the sheet 1002 unfavorably adheres to the outer periphery of the photosensitive drum 1003, which causes a failure of operation.

Figure 5:
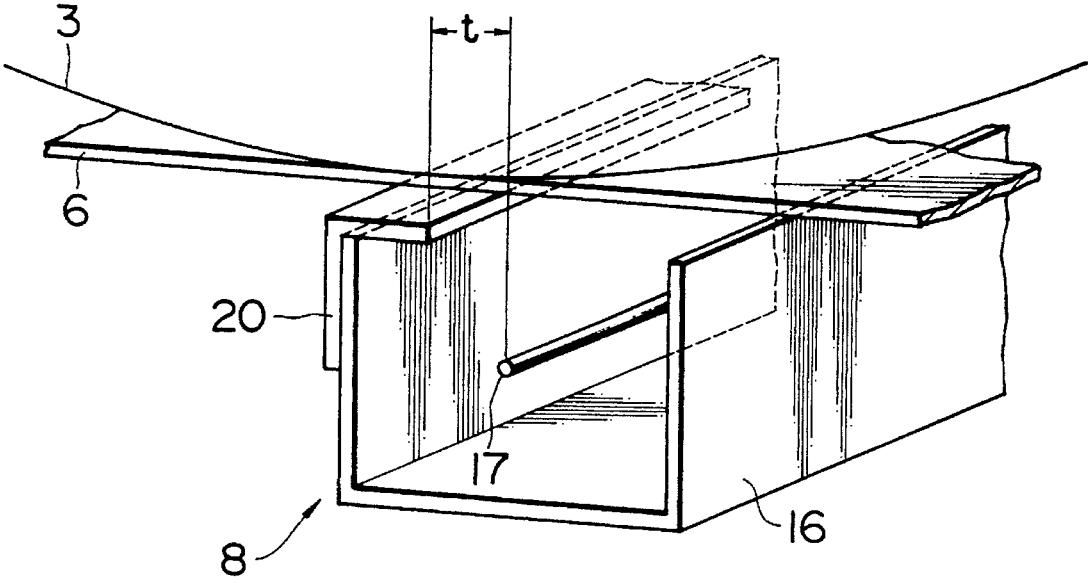
FIG. 5 is a perspective view of a corona electrical charger of the transfer device shown in FIG. 2.

In the transfer device according to this embodiment, as shown in FIG. 5, a shielding plate 20 is provided on the charger 8 for reducing a transfer current flowing through the outlet and its neighborhood of the transfer section. The shielding plate 20 is located on the outlet side of the transfer section so as to partially close the opening of the can 16. The shielding plate 20 is made of a dielectric material. Alternatively, the shielding plate 20 may be made of an electrically conductive material. The shielding plate 20 is formed such that an end thereof lies at a distance t from the wire 17 which substantially corresponds to the center of the transfer section T. The distance t is set so that, when compared with the width $T'_2$ on the outlet side of the transfer section as illustrated in FIG. 4, the distance t and with $T'_2$ are in a relationship of $t \leqq T'_2$.

Figure 10:
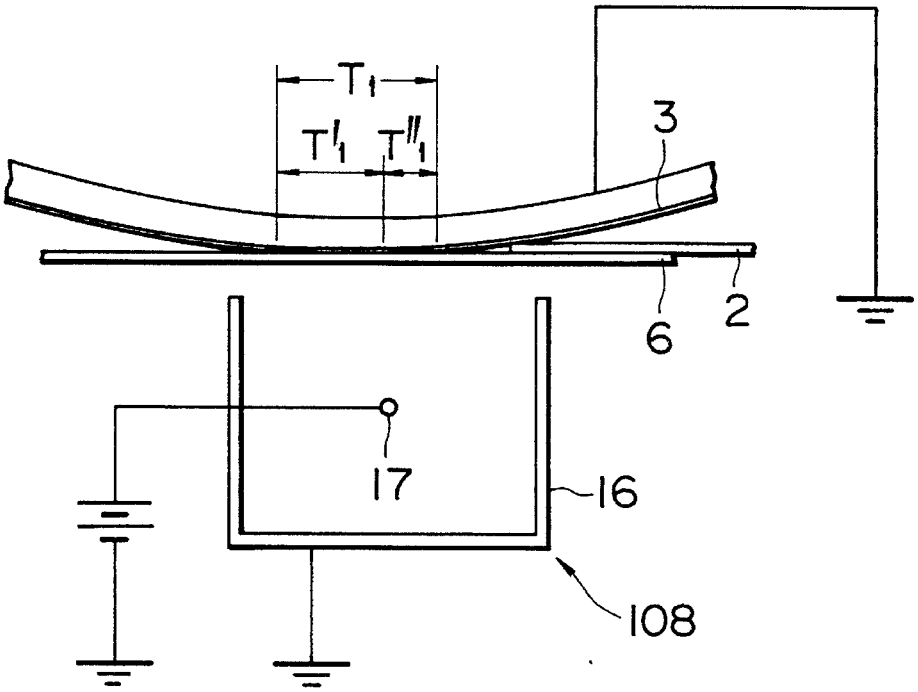
FIG. 10 is a schematic view of a portion of a belt-type transfer device according to another embodiment of the invention.

In the belt-type transfer device according to the embodiment of FIG. 10, the means for reducing a current flow to the outlet of the transfer section comprises the relative location of a corona electric charger 108 to the transfer section, in place of the shielding plate 20 described above. FIG. 10 illustrates the transfer device in a non-operation condition, in which a width of the transfer section is represented by $T_1$ similarly to the case of FIG. 3. The electric charger 108 is located such that it comes as a whole near the inlet of the transfer section with respect to a center of a contact area between a photosensitive drum 3 and an endless belt 6 at the time when the belt-type transfer device is not operated. In this embodiment of FIG. 10, a width $T'_1$ on the outlet side of the transfer section with respect to a wire 17 of the electric charger and a width $T''_1$ on the inlet side are set to be in a relationship of $T'_1>T''_1$.

As described above with reference to FIGS. 3 and 4, when the transfer device is operated, the transfer section shifts in the direction toward the outlet thereof. In the embodiment of FIG. 10, since the corona electric charger 8 is situated near the inlet, the transfer section further shifts in the direction towards the outlet relative to the wire 17 during operation of the apparatus, so that a current flowing through the outlet and its neighborhood of the transfer section is reduced.

Referring to FIGS. 3 and 4 again, adhesion of the sheet 1002 to the outer periphery of the photosensitive drum 1003 depends upon the electrostatic attraction force between the belt 1006 and the sheet 1002. And, the attraction force depends on the inflow current $i_o$ in the vicinity of the inlet and at the center of the transfer section. Accordingly, if the current $i_o$ flowing through the belt 1006 is increased, the electrostatic attraction force between the belt 1006 and the sheet 1002 is also increased so as to prevent the sheet 1002 from adhering to the outer periphery of the photosensitive drum 1003.

To this end, when the current $i_w$ to the wire 1017 of the corona electric charger is constant, it is effective to decrease the current $i_c$ flowing to the can 1016 and increase the inflow current $i_o$ to the belt 1006.

Figure 6:
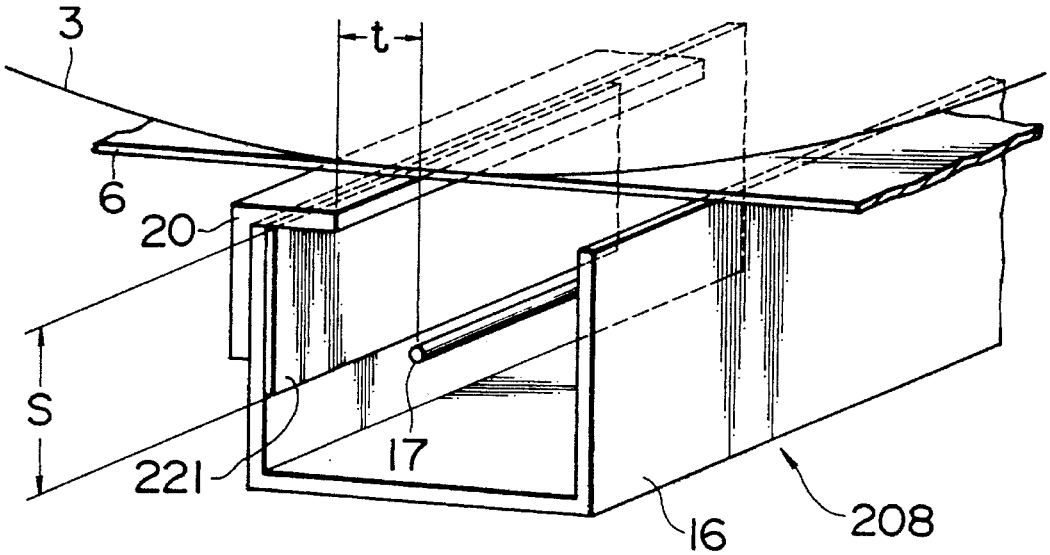
FIG. 6 is a perspective view of a modification of the corona electrical charger of FIG. 5.

In the modified transfer device of FIG. 6 means are provided for increasing a current $i_o$ flowing through the endless belt, in addition to the structure of the first described embodiment. The means comprises a film 221 which is made of a dielectric material and is located on the outlet side of the transfer section. The film 221 has a width s and is adhered to an inner surface of a side wall of the can 16 of a corona electric charger 208 to face the wire 17. The film 221 serves to decrease the current $i_c$ flowing to the can 16 to thereby increase the inflow current $i_o$ through the belt 6.

With the corona electrical charger 8 of the embodiment shown in FIG. 5, a similar effect can be expected if the current $i_w$ to the wire 17 is increased to thereby increase the current $i_o$ flowing to the belt 6.

The cleaning mechanism of the belt-type transfer device will now be explained with reference to FIG. 7. This mechanism constitutes the first embodiment, but it may be similarly employed in the other embodiments and modification.

As described above, the endless belt 6 is rotated in contact with the driving pulley 11, the follower pulley 12, the inlet pulley 13, and the inlet and outlet auxiliary shafts 15, 14. A lower half portion of the belt 6 is surrounded by the casing which is formed by the side plate 18 and the bottom plate 19. The cleaning mechanism comprises a corona charge remover 22, a fur brush 23 and a magnet roll 24 which are received in the casing. Clearing of the toner remaining on the belt 6 after the image transferring is carried out through the steps of removing the electric charge of the toner on the belt 6 by the charge remover 22, then sweeping the toner by the fur brush 23, and collecting the toner by the magnet roll 24. The bottom plate 19 prevents dispersion of the toner during the cleaning.

The auxiliary shafts 14 and 15 shown in FIG. 7 support the belt 6 at the transfer section and increase the mechanical contact force between the belt 6 and the photosensitive drum 3, thereby improving a transferring efficiency of the toner. Also, the sheet 2 and the drum 3 contact each other more closely, and the electrostatic attraction force between them is increased. As a result, a stable transferring operation can be realized.

A variation of the charged potential of the transfer belt affects the adhesion of the recording sheet around the photosensitive drum and the transferring operation efficiently. To avoid such a variation, it is preferable to maintain the charged potential of the belt at a constant level to surely prevent the adhesion of the sheet and to improve the transferring operation efficiency.

Figure 8:
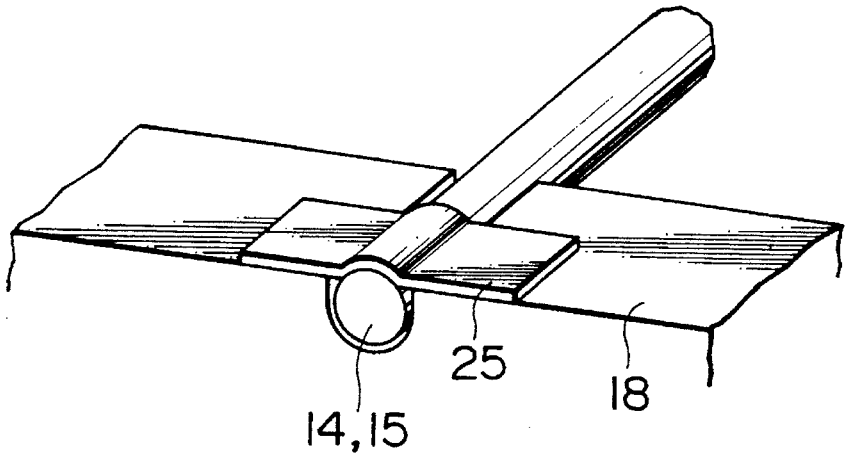
FIG. 8 is a perspective view of a method of grounding a shaft utilized in the transfer device of FIG. 2.
Figure 9:
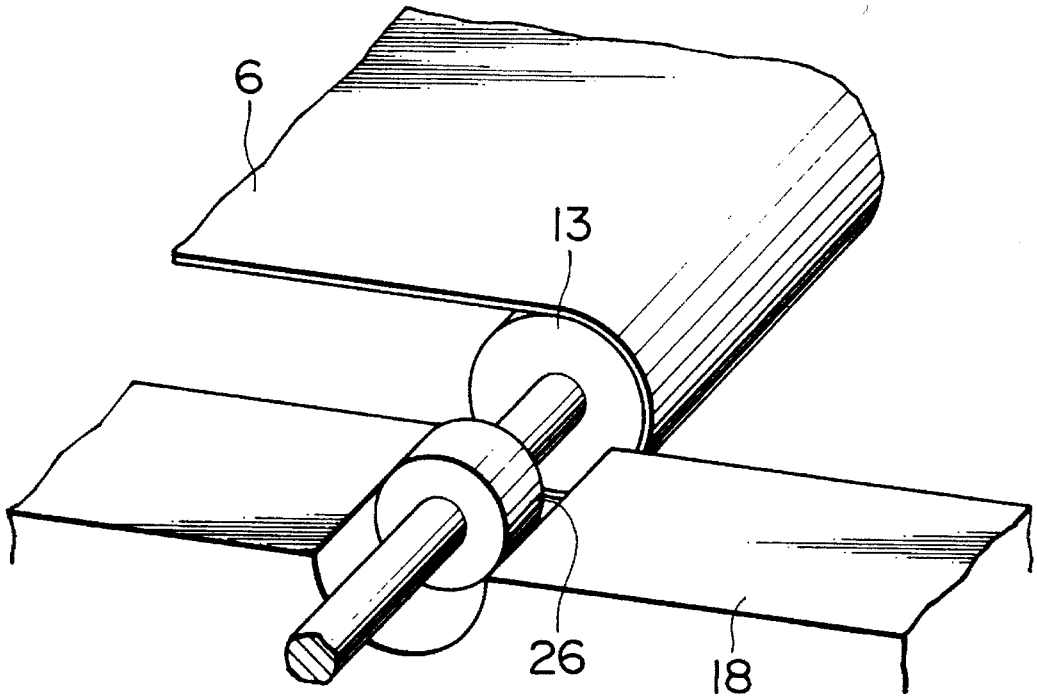
FIG. 9 is a perspective view of a method of grounding a pulley utilized in the transfer device of FIG. 2.

In each of the transfer devices of the above embodiments and modification, the driving pulley 11, the follower pulley 12, the inlet pulley 13, and the inlet and outlet auxiliary shafts 15, 14 are all grounded in order to stabilize the charged potential of the belt 6. FIG. 8 illustrates an example of a method of grounding. The auxiliary shafts 14, 15 are electrically connected to the conductive side plate 18 through thin plates 25 made of an electrically conductive material. As shown in FIG. 9, the inlet pulley 13 is rotatably supported by a conductive bearing 26 to be electrically connected to the side plate 18. The driving pulley 11 and the follower pulley 12 are similarly electrically connected to the side plate 18.

Further, it is preferable to control the current $i_w$ to the high-voltage wire of the corona electric charger in accordance with a kind of a recording sheet or a value of its electric resistance.

When printing is made on both sides of a recording sheet, for instance, a moisture content of the sheet in case of printing on one side of the sheet at first and that in case of printing on the other side of the sheet on the second time are different from each other, because of heating by the fixing device. For this reason, even if the current of a fixed value is applied to the corona electric charger, the sheet is not always charged at the same value, so that a stable printing and separation of the sheet cannot be performed. To avoid such a trouble, in an electrophotographic apparatus for performing duplex printing, it is desirable that the current $i_o$ flowing through the transfer belt is so controlled at the time of printing on the back side of a sheet as to be larger than that at the time of printing on the front side of the sheet. With such structure, the electrostatic attraction force between the recording sheet and the photosensitive drum is increased to enable a stable transferring.

Figure 11:
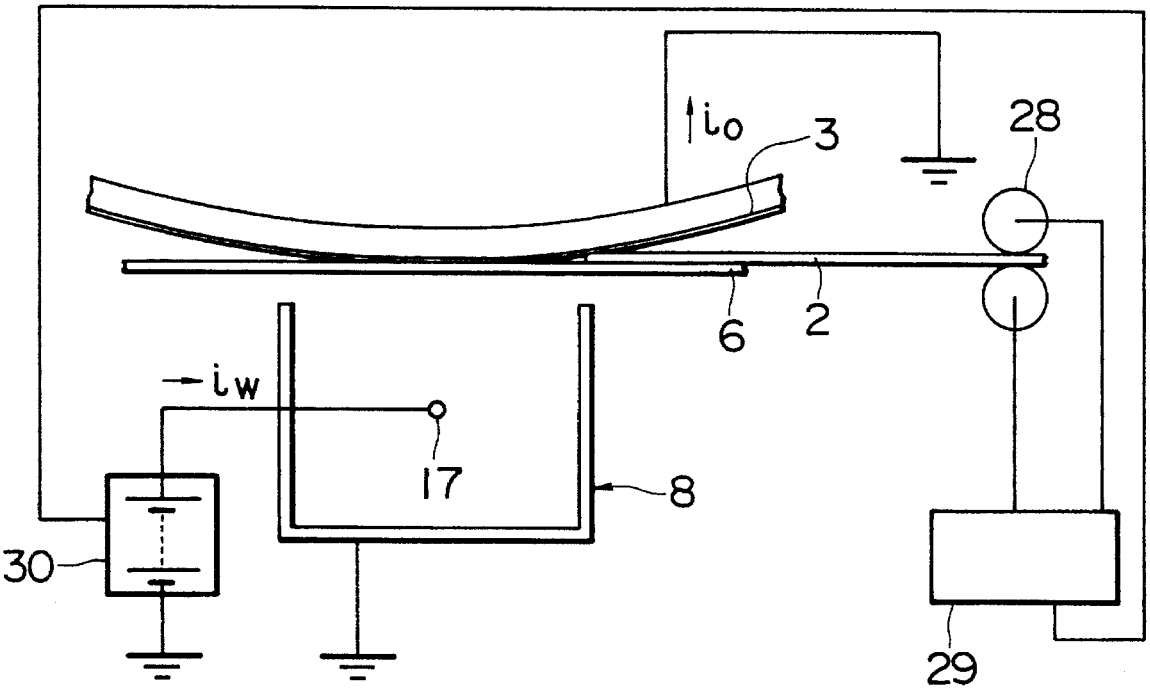
FIG. 11 is a schematic view portion of a belt-type transfer device according to another embodiment of the invention.

The embodiment of FIG. 11 is provided with high-voltage electric power source control means for controlling the current $i_o$ flowing through the transfer belt. The control means include a pair of conductive rollers 28, a comparator 29 electrically connected to these rollers, and a high-voltage electric power source 30 capable of changing an output current.

The rollers 28 are located near the endless belt 6, and a recording sheet 2 is transported to the belt 6 through the rollers 28. The comparator 29 measures a value of electric resistance of the sheet 2 via the rollers 28 and compares the measured value with a predetermined value. A moisture content of the sheet 2 is represented by its electric resistance value. The comparator 29 is electrically connected to the power source 30. A current $i_w$ output from the power source 30 to the wire 17 of the corona electric charger 8 is controlled in accordance with the detected electric resistance value of the sheet so that the current $i_o$ flowing through the belt 6 and the photosensitive drum 3 is kept at a substantially constant value.

The embodiment of FIG. 11 has been described as controlling the output current in accordance with the moisture content of the recording sheet, but it is applicable in the case where several types of recording sheets having different electric resistance values are used.

Figure 12:
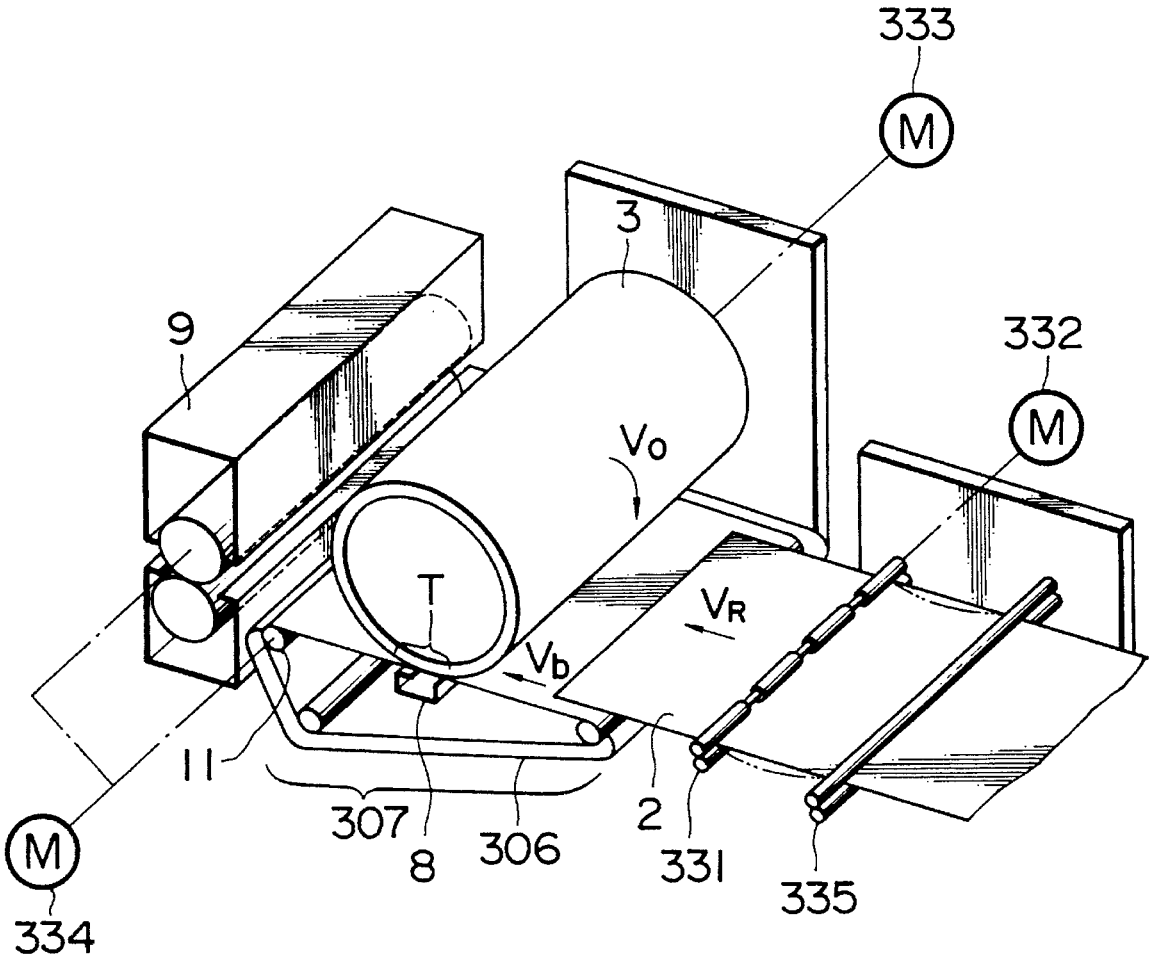
FIG. 12 a perspective view of a belt-type transfer device and associated portions according to yet another embodiment of the invention.

Referring to FIG. 12, illustrated are a belt-type transfer device 307 and its associated portions such as a registration device, a photosensitive drum and a fixing device. Resist rollers 331 and the photosensitive drum 3 are rotatably supported by different side plates and are respectively individually rotated by driving systems 332 and 333. The transfer device 307 is installed to, as a whole, swingably move around the driving pulley 11 in order to come away from or closer to the photosensitive drum 3. The transfer device 307 includes the endless belt 306 formed of a dielectric elastic material, with the belt 306 being driven by the pulley 11, and with the pulley 11 and rollers of the fixing device being rotated by a common driving system 334.

Delivery rollers 335 are provided on an upstream side of the resist rollers 331 with respect to a direction of transportation of the delivery of a recording sheet 2. The sheet 2 is first conveyed by the rollers 335, and a leading edge of the sheet 2 comes in contact with the resist rollers 331 which are not operated. At this time, if the sheet 2 advances obliquely or skews, it curves between the rollers 331 and 335. Then, the rollers 331 are rotated at a speed $V_R$ synchronously with a toner image on the photosensitive drum 3 to feed the sheet 2 to the dielectric belt 306 in a condition that its skewing has been corrected. The sheet 2 is guided by the belt 306 to the transfer section T. In the illustrated embodiment, a speed of the belt 306 is so controlled as to be equal to a speed of the photosensitive drum 3, or to be lower by 0.5% or less of the drum speed. Representing the speed of belt 306 and that of the photosensitive drum 3 as $V_b$ and $V_o$, respectively, $V_b$ is in a relationship of $(1-0.005)V_o \leqq V_b \leqq V_o$.

In this case, a moving speed $V_p$ of the sheet 2 (FIG. 14) is equal to the speed $V_b$ of the belt 306.

Figure 13:
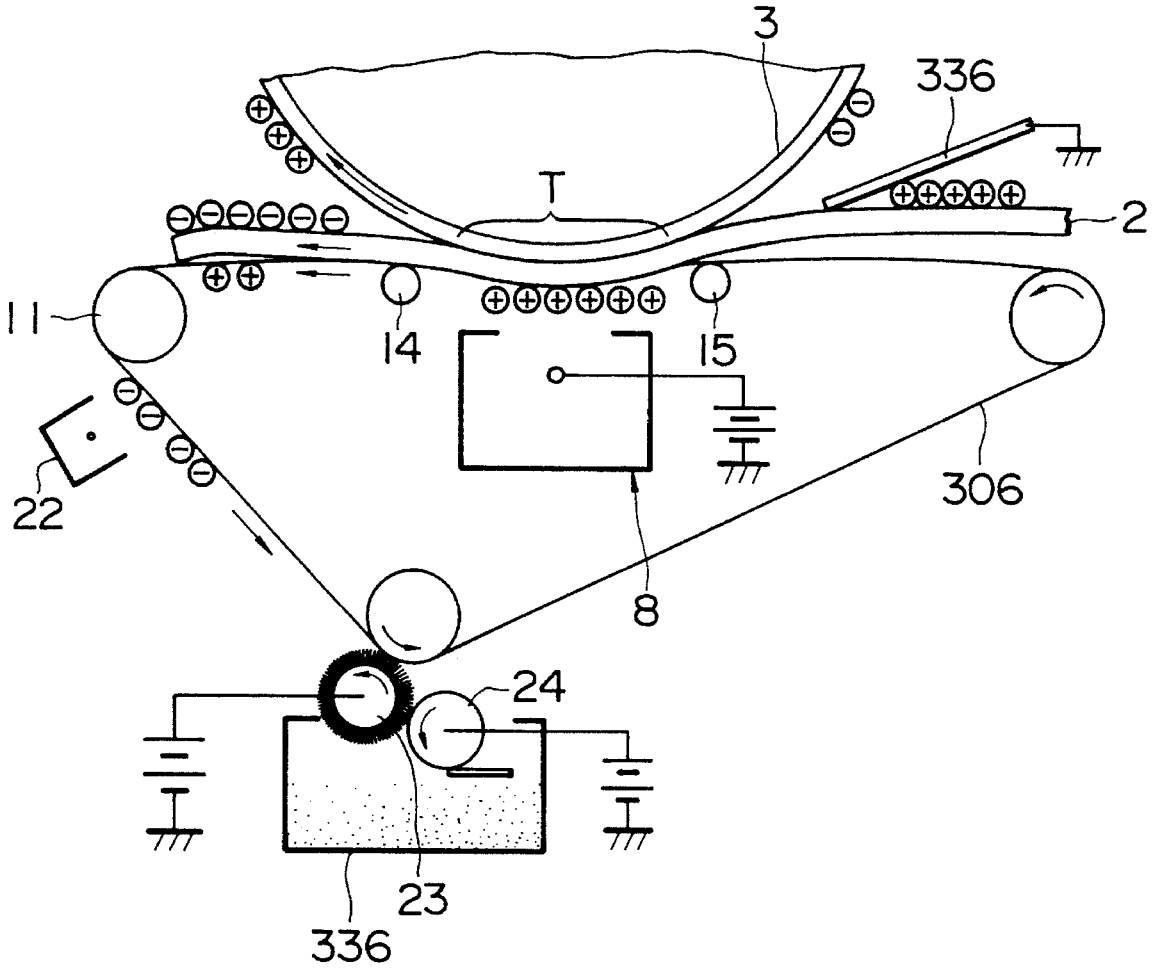
FIG. 13 is an enlarged schematic view of transfer device of FIG. 12.

An operation of the belt-type transfer device 307 will be described with reference to FIG. 13. The sheet 2, separated and fed from a hopper of an electrophotographic apparatus, is positively-charged at its surfaces. The sheet in the above state is delivered to the transfer section T while being guided by a front guide 336 which is provided above the belt 306. At the transfer section T, the auxiliary shafts 14, 15 are located inside the belt 306 to bring the belt 306 into close contact with the photosensitive drum 3. A toner image formed on an outer periphery of the photosensitive drum 3 is negatively-charged, and it is transferred onto the sheet 2 due to positive electrical charge by the transfer corotron 8. Transferring of the toner image is thus performed.

After separating from the photosensitive drum 3, the surfaces of the sheet 2 are negatively-charged and the sheet is electrostatically attracted by the positively-charged belt 306 so as to be delivered. When the leading edge of the sheet 2 reaches the position of the driving pulley 11, the sheet 2 separates from the belt 306 due to its flexural rigidity.

The electric charge of the dielectric belt 306 is then removed by the negative electric charger 22. The toner remaining on the belt 306 is attracted by the positive-charged fur brush 23, collected by the bias roller 24, and stored in a discharged toner hopper 336.

Figure 14:
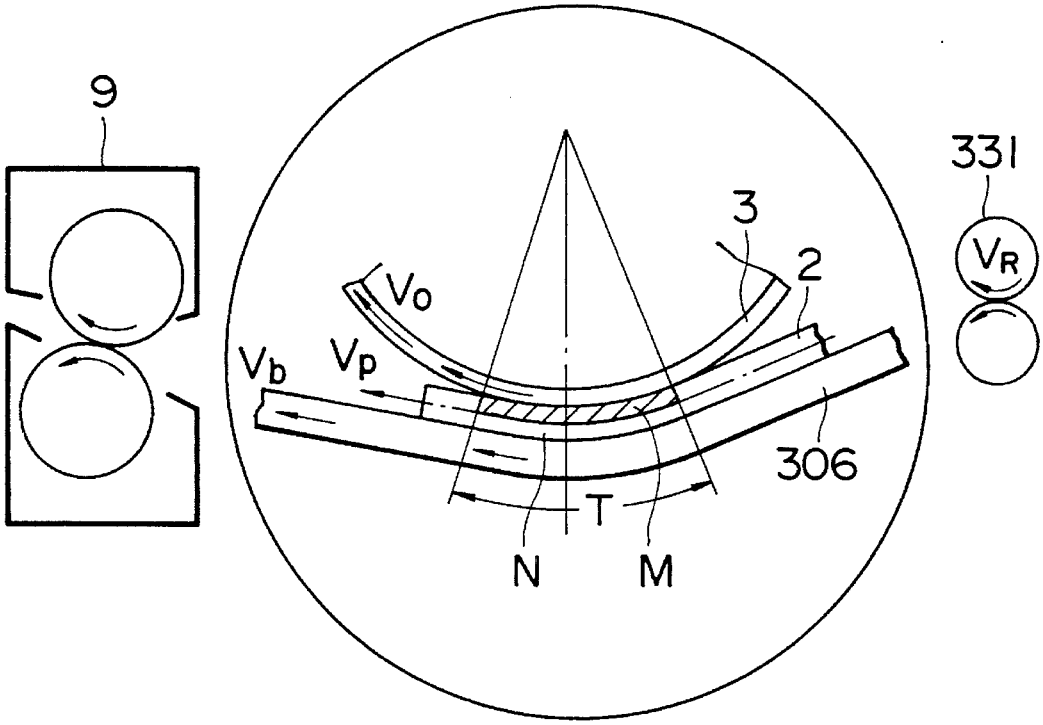
FIG. 14 is an enlarged view of a transfer nip portion in the transfer device of FIG. 12.

As shown in FIG. 14 sheet 2 contacts the photosensitive drum 3 with the aid of the mechanical biasing force and the electrostatic force. A width of a contact area between the sheet and the drum is called a nip width, and is referred to as the transfer section T in this description. In the transfer section T, because the sheet 2 deforms along the outer periphery of the photosensitive drum 3, there exist a region M where a compression force acts on the sheet and a region N where a tensile force acts on the sheet.

In the embodiment of FIG. 14, because the photosensitive drum 3 and the dielectric belt 306 rotate in the above-described relationship of speed, a shearing force, i.e., a force for causing a divergence or slippage between them acts thereon, so that the compression force in the region M is reduced. As a result, a front edge of the sheet 2 deforms or tends to deform in a direction apart from the drum 3, and accordingly, the sheet 2 is readily attracted by the belt 306. Thus, the problem of the sheet adhering to the outer periphery of the photosensitive drum 3 can be prevented.

Figure 15:
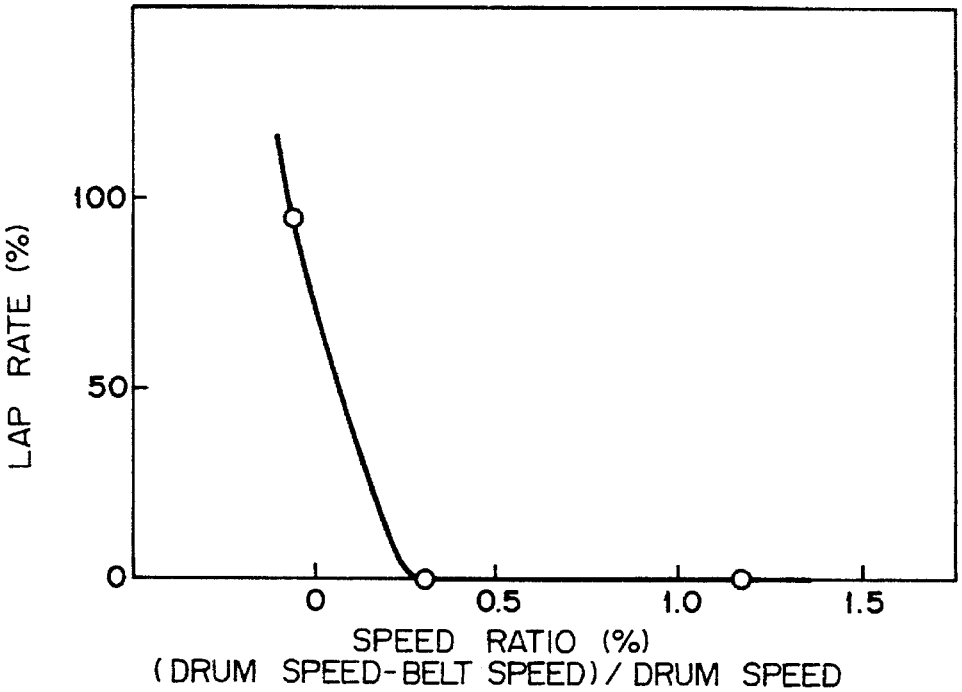
FIG. 15 is a graphical illustration of a relationship between a speed ratio of a photosensitive drum to a transfer belt and a lap rate.

FIG. 15 shows a result of experiments in which frequency of erroneous adhesion (referred to as a lap rate hereinafter) is examined when recording sheets of a type liable to adhere to the outer periphery of the photosensitive drum are used and when a speed of the dielectric belt is changed. A speed ratio in the graph is given by the following expression: (photosensitive drum speed—dielectric belt speed)/photosensitive drum speed. It is understood from the result shown in FIG. 15 that lapping can be prevented when the speed ratio is 0.3% or more.

Figure 16:
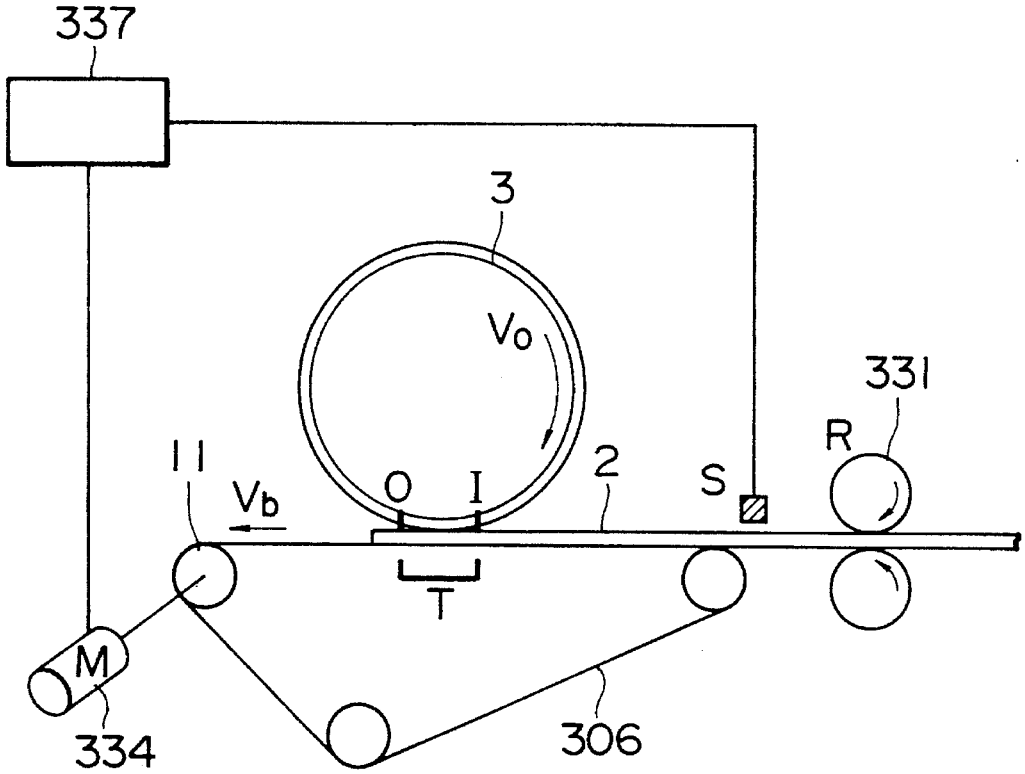
FIG. 16 is a schematic view showing a speed control system for a transfer belt in the transfer device of FIG. 12.
Figure 17:
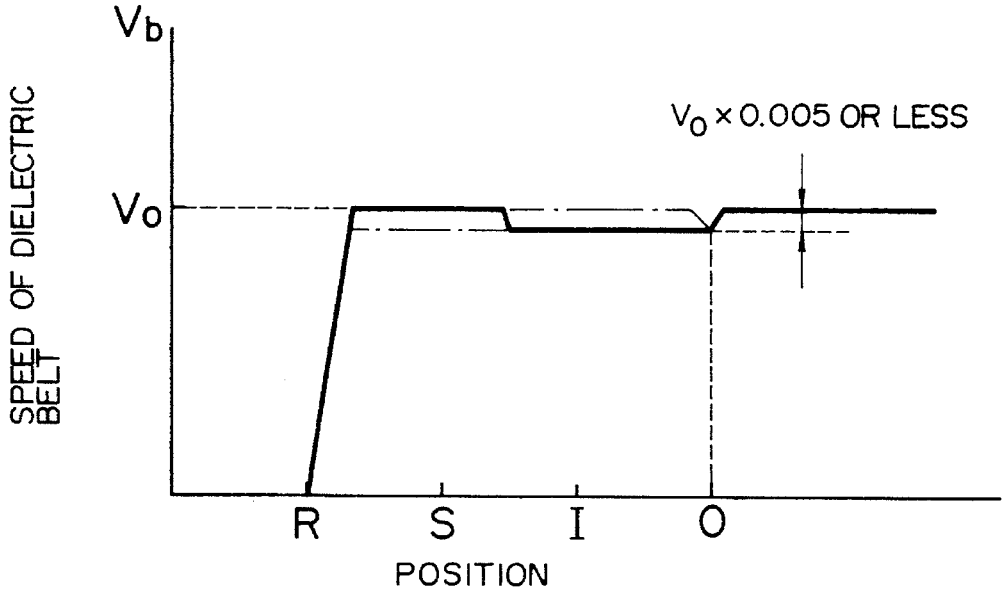
FIG. 17 is a graphical illustration of a relationship between a position of movement of a recording sheet and a belt speed in the transfer device of FIG. 12.

If the speed of the photosensitive drum differs from that of the dielectric belt, however, a length of the image formed on the recording sheet inevitably varies. The present invention, in order to minimize such a variation, controls the drum and the belt such that they are driven in the above-described speed relationship up to a position O where the front edge of the sheet exits the transfer section T, and thereafter they are driven at the same speed, as illustrated in FIGS. 16 and 17. With this control, a change in length of the image occurs only in a small part thereof, which would cause no problems in practical use, and it is possible to reduce the lap rate.

To perform the above control, the belt-type transfer device includes a sheet detecting sensor S which is provided in front of the belt 306, and means 337 for controlling the driving system 334 in response to an output of the sensor. When the sheet 2 is fed by the resist rollers 331, the sensor S detects passage of the sheet. The control means 337, upon receiving the output signal of the sensor S, controls the driving system 334 to reduce the speed of the belt 306 by $0.005\times V_o$ or less. After the front edge of the sheet passes the position O where it exits the transfer section T, the control means 337 effects its control so that the belt speed is equal to $V_o$. The sensor S may be the combination of a light source and a photo diode. The passage of the position O by the sheet front edge is judged by a lapse of time from the occurrence of the output of the sensor S.

The reduction of the speed of the dielectric belt may be started at any arbitrary position within a range which is indicated by a dot and dash line in FIG. 17. For instance, the belt speed may be continuously reduced by $0.005\times V_o$ or less until the sheet front edge passes the position O of the outlet through the position R of the resist rollers 331 and the position I of the inlet of the transfer section. Alternatively, the belt speed may be controlled to be equal to $V_o$ immediately before the sheet front edge reaches the position O of the transfer section, then reduced by $0.005\times V_o$ or less until the sheet front edge exits the position O, and returned to $V_o$ after the sheet front edge passes the position O.

In place of controlling the belt speed to reduce the lap rate, control may be effected to increase or decrease the speed of the resist rollers. Also in this case, a similar effect to the above-described embodiment can be expected in stabilizing a motion of the front edge of the sheet to prevent the lapping.

Figure 18:
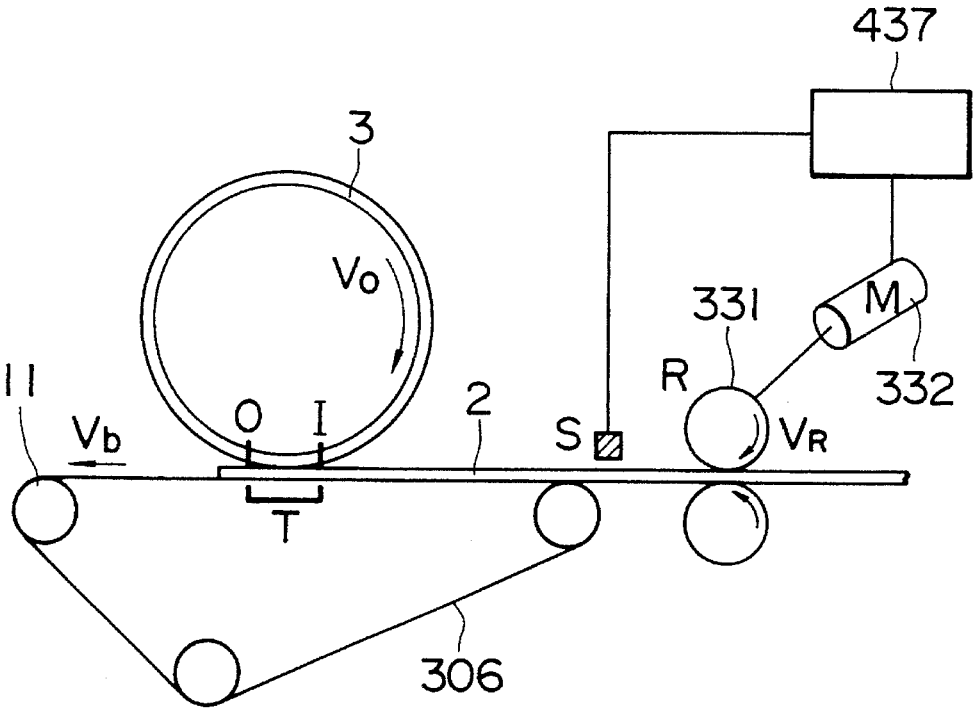
FIG. 18 is a schematic view of a speed control system for resist rollers in a belt-type transfer device according to another embodiment of the invention.

A belt-type transfer device of the embodiment of FIG. 18 includes a controller 437 in place of the control means 337 of FIG. 16. The controller 437 controls the driving system 332 of the resist rollers 331 in accordance with an output signal of the sheet detecting sensor S. When the sheet 2 is delivered by the resist rollers 331 to pass the sensor S, the controller 437 reduces a speed of the rollers 331 by $0.005\times V_o$ or less. Thereafter, when the front edge of the sheet passes the position 0 of the transfer section T, the speed of the resist rollers is returned to $V_o$.

Figure 19:
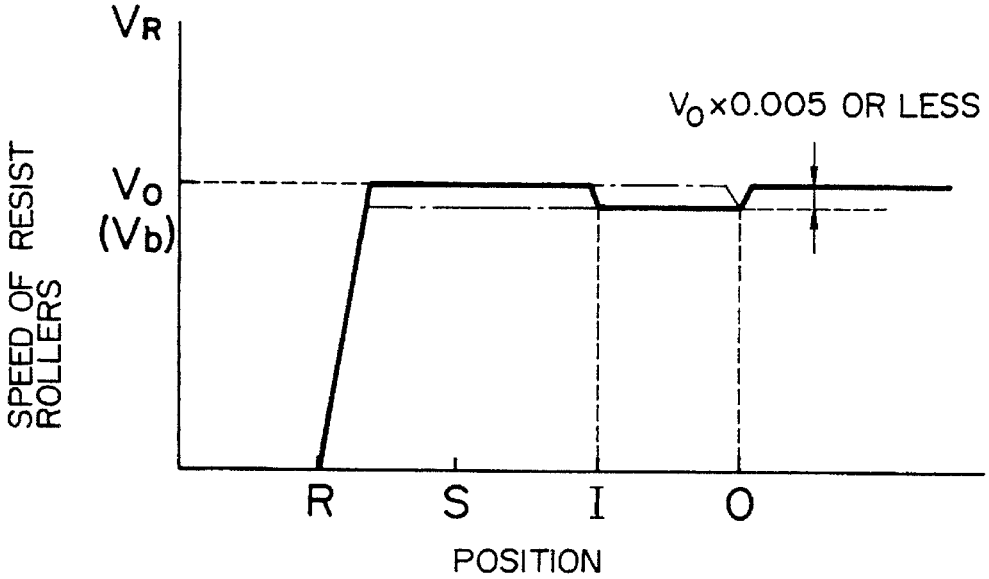
FIG. 19 is a graphical illustration of a relationship between a position of movement of a recording sheet and a speed of the resist rollers in the transfer device of FIG. 18.
Figure 20:
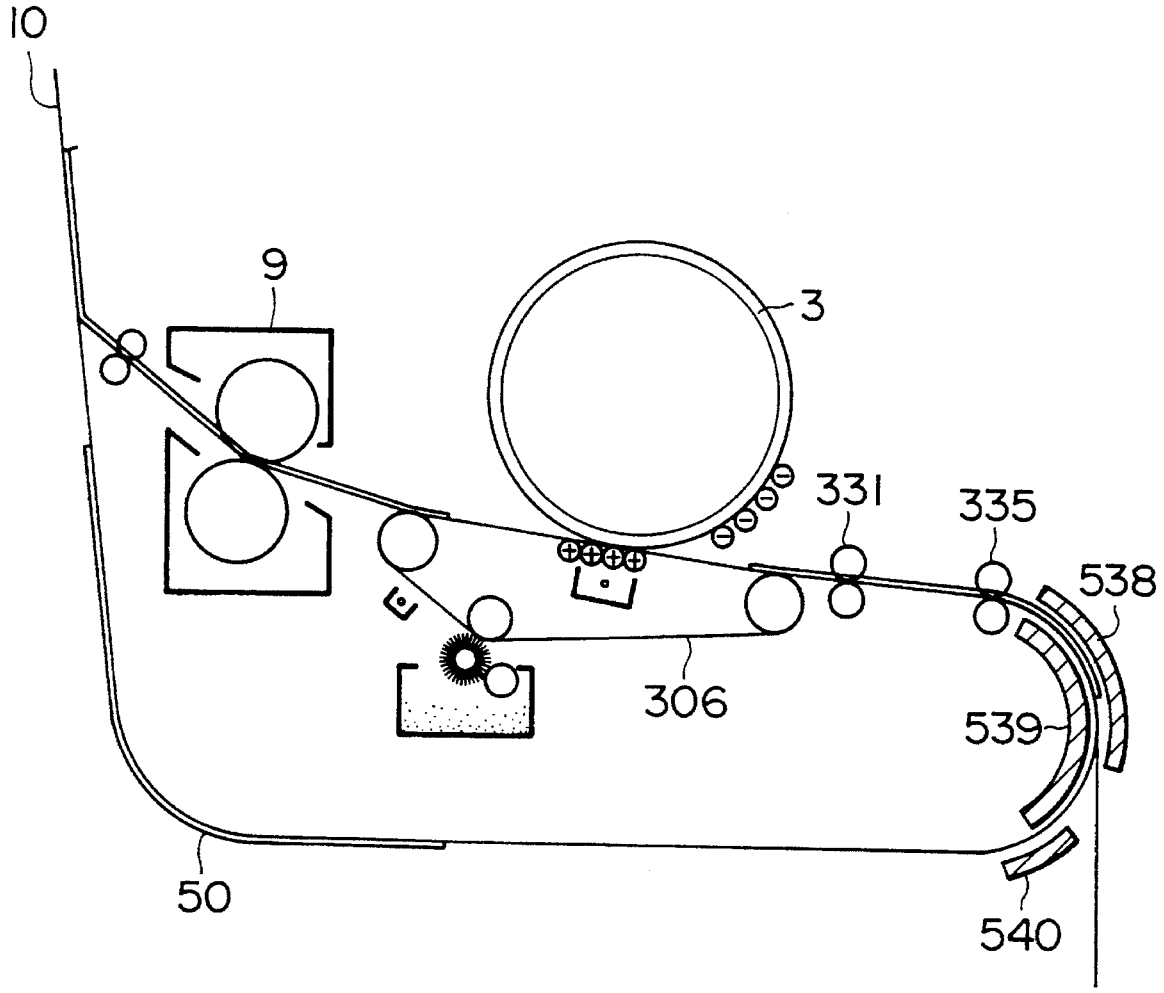
FIG. 20 is a schematic view of a portion of an electrophotographic apparatus according to another embodiment of the invention.

The reduction of the speed of the resist rollers may be started at any arbitrary position within a range which is indicated by a dot and dash line in FIG. 19. For instance, the speed of the resist rollers may be continuously reduced by $0.005\times V_o$ or less until the front edge of the sheet passes the outlet position O of the transfer section T through the resist rollers 331. Alternatively, the resist roller speed may be controlled to be equal to $V_o$ immediately before the sheet front edge reaches the position O of the outlet of the transfer section T, then reduced by $0.005\times V_o$ or less until the sheet front edge passes the position O, and returned to $V_o$ after the sheet front edge passes the position O.

In a belt-type transfer device, it is desirable to minimize the electrical charge of a recording sheet which is to be fed to the transfer section, in order to realize a good image transferring operation wherein unfavorable dispersion of toner is minimized and a lap rate is low. A value of electric resistance of a recording sheet largely varies depending upon a condition of the environment such as the humidity, depending on the kind of the sheet, and further depending on whether it is before or after the image fixation process. The transferring operation efficiency also changes in accordance with a variation of the electrical resistance value. The electrical charge of the sheet is influenced to a large extent by sheet delivery guides which are provided along the sheet transportation path and often come in frictional contact with the sheet during delivery. An electric charge of the recording sheet is sometimes increased due to the frictional contact between the sheet and the guides. A reduction of an electrical resistance value of the delivery guides enables the electrical charge of the sheet resulting from the frictional contact to be decreased. To this end, it can be thought of to form the sheet delivery guides of an electrically conductive metal. The use of a metal material for the sheet delivery guides is, however, disadvantageous in that the material is expensive, and it is difficult mass-produce the guides because a metal material is difficult to form into a complicated shape which is often required for the guide.

A plastic material is relatively inexpensive and easily formable. It is accordingly preferable to form the sheet delivery guides of a plastic material having a value of electrical resistance which allows the electric charge of a recording sheet to be decreased even when the guides come in frictional contact with the sheet. In general, a plastic material has a low electric conductivity. Carbon or a conductive filler needs to be mixed in the plastic material to reduce the electric resistance. Thus, the manufacturing cost depends on a value of electrical resistance required for the plastic material. This is because mixed conductive filler decreases fluidity of the original material so that a yield of production is lowered.

The electrophotographic apparatus includes guides 538, 539, 540 which are provided along a sheet delivery path leading to a belt-type transfer device. These sheet delivery guides are provided at positions which are uptream of delivery rollers 335 with regard to a direction of conveyance of a sheet. The guides 538 to 540 are formed of a plastic material having a specific electric resistance of $10^{11}$ Ωcm or less.

Figure 21:
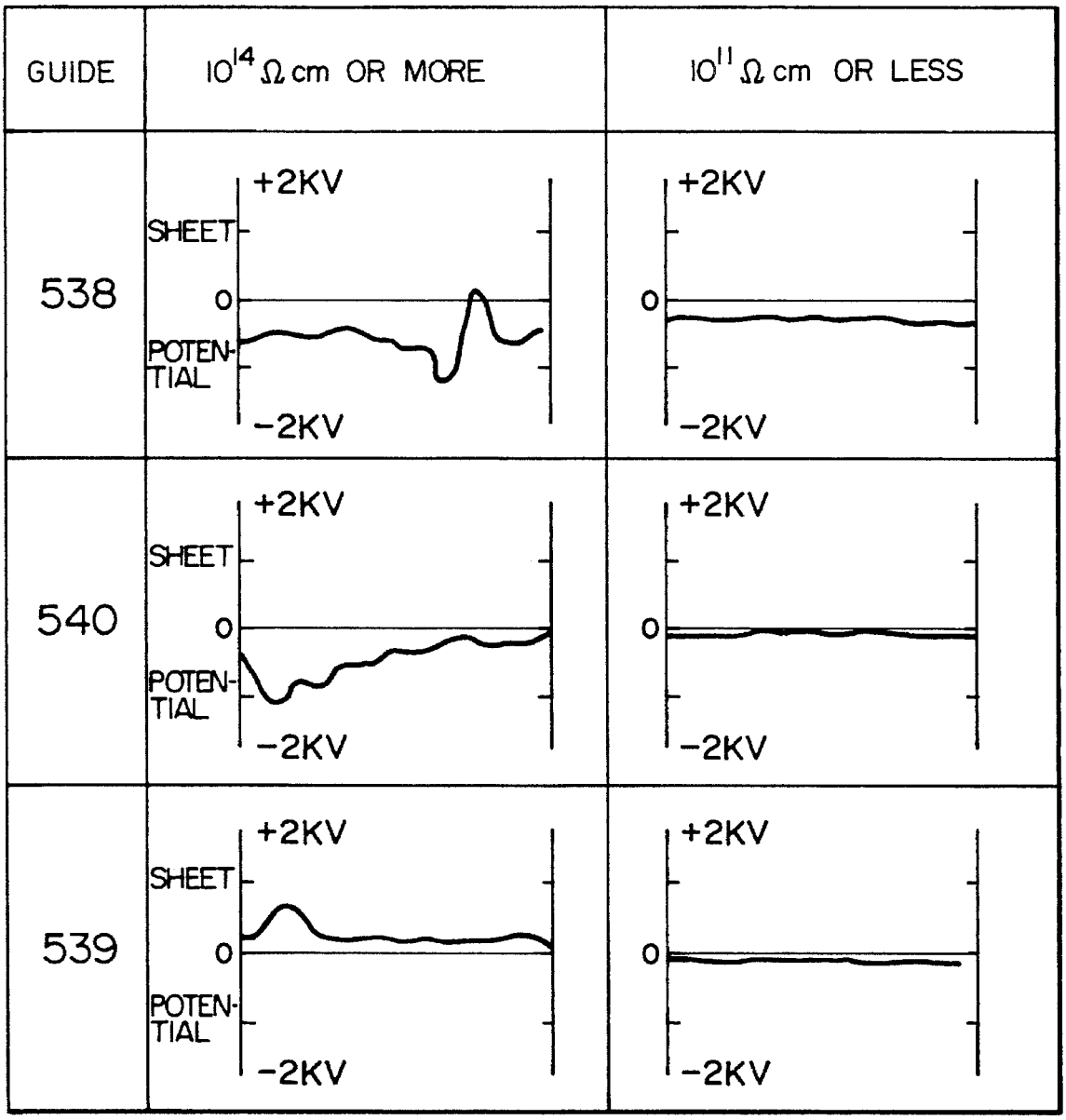
FIG. 21 is a diagram illustrating a relationship between specific electrical resistances of sheet delivery guides and electric charges thereof in the electrophotographic apparatus of FIG. 20.

FIG. 21 indicates a result of experiments in which electrical charges of the guides 538 to 540 were measured when the guides were formed of a material having a specific electric resistance of $10^{11}$ Ωcm or less and when they were formed of a material having a specific electric resistance of more than $10^{14}$ Ωcm. The electrical charge of each guide was measured in a direction of width of the guide. As understood from the result shown in FIG. 21, the sheet delivery guides having the specific electric resistance of more than $10^{14}$ Ωcm were charged up to −2 kV at the maximum on the negative side. At this time, the charge of a recording sheet was +2 kV. Whereas, the guides having the specific electric resistance of $10^{11}$ Ωcm or less were charged up to −200 V even at the maximum.

The specific electric resistance at the level of $10^{11}$ Ωcm can be achieved by mixing a small quantity of carbon or a conductive filler in a plastic material. Therefore, the sheet delivery guide employed by the invention can readily be manufactured by a formation processing which is substantially similar to that required in a case where a plastic material subjected to no conduction treatment is used.

Figure 22:
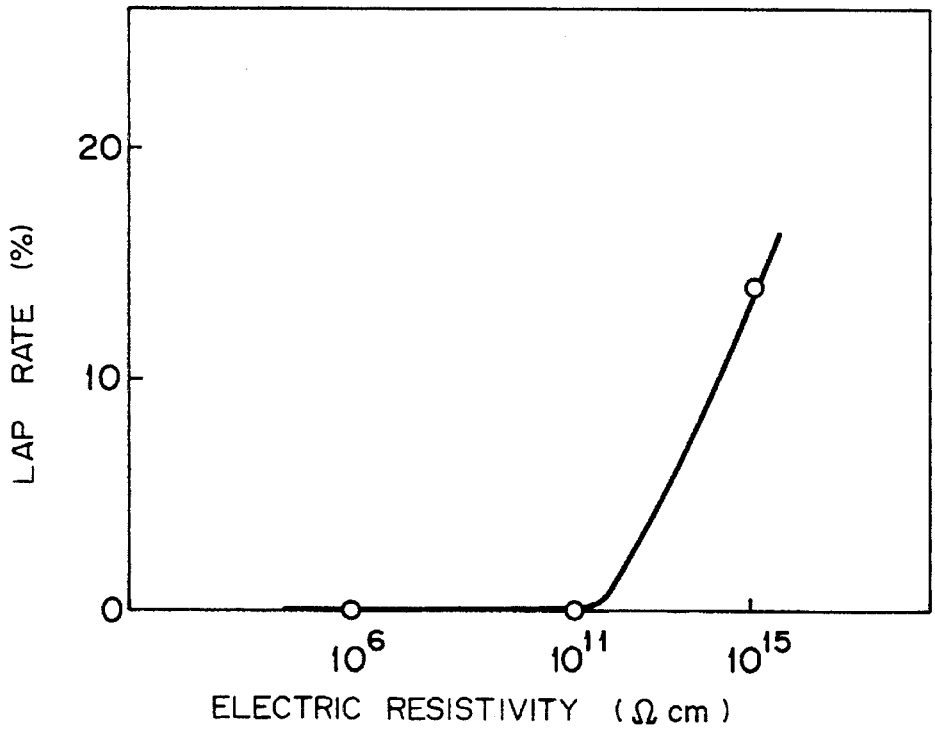
FIG. 22 is a graphical illustration of a relationship between specific electrical resistances of the sheet delivery guides and a lap rate in the electrophotographic apparatus of FIG. 20.

As shown in FIG. 22, when the specific electric resistance is $10^{15}$ Ωcm, the lap rate is about 14%. When the specific electric resistance is $10^{11}$ Ωcm, the lap rate decreases to 0%. Thus, adhesion of the sheet to the outer periphery of the photosensitive drum does not occur, and a good transferring operation can be realized.

Figure 23:
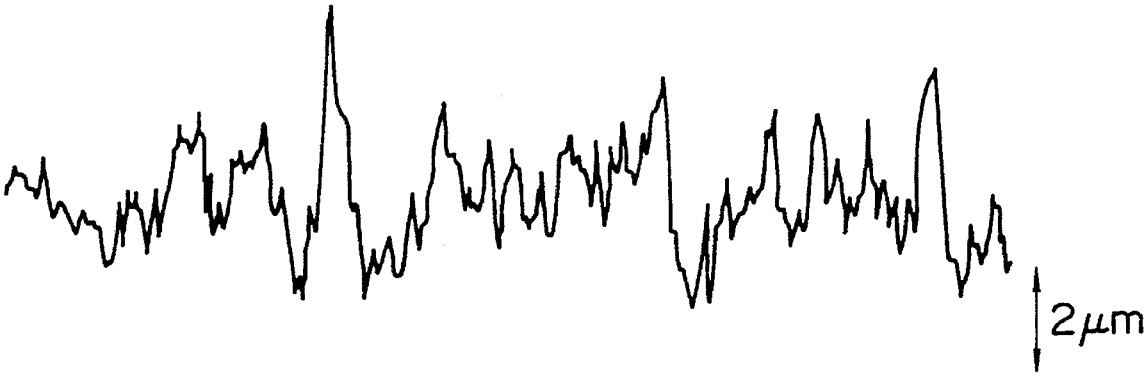
FIG. 23 is a view showing an unevenness state of a surface of a transfer belt in an enlarged scale, the belt having a value of surface roughness of Rmax 6 μm.
Figure 24:
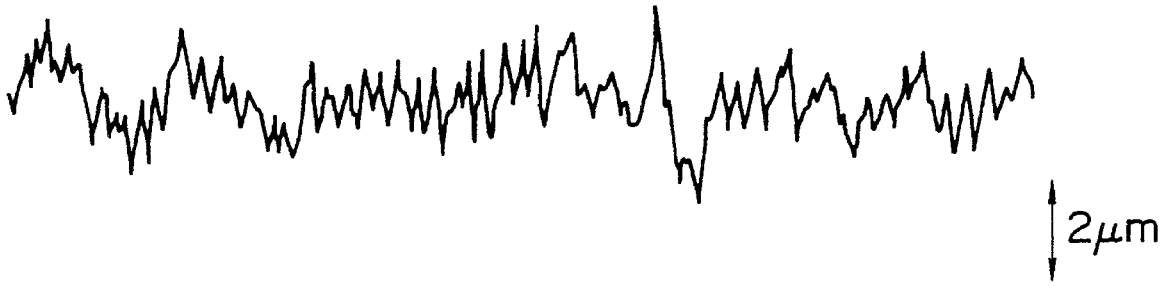
FIG. 24 is a view showing an unevenness state of a surface of a transfer belt in an enlarged scale, the belt having a value of surface roughness of Rmax 4 μm.
Figure 25:
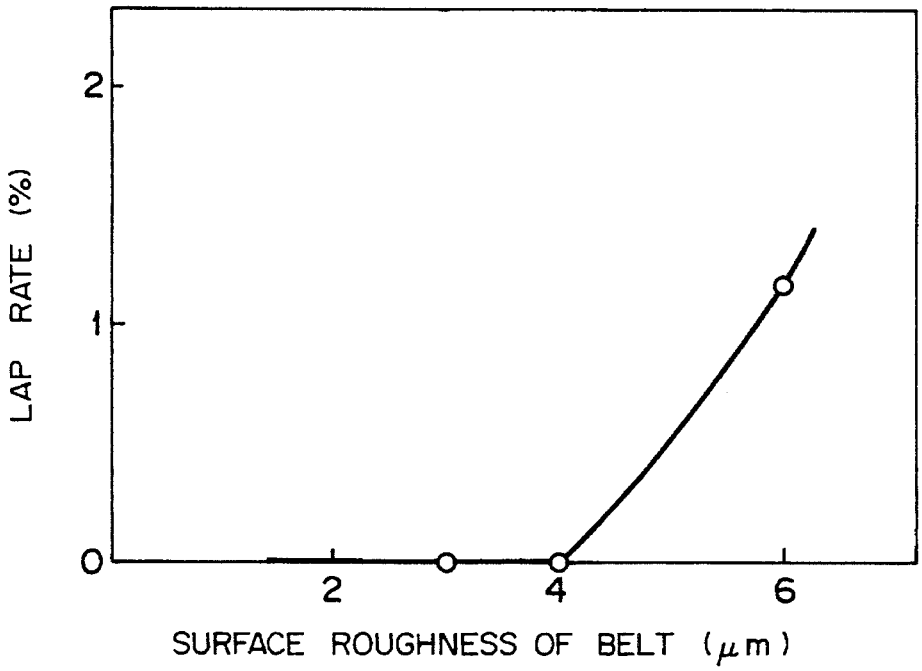
FIG. 25 is a graphical illustration of a relationship between values of surface roughness of a transfer belt and a lap rate.

Further, in order to further ensure the prevention of adhesion of a sheet around the photosensitive drum, it is necessary to consider a surface roughness of the transfer belt. More particularly, when a surface of the transfer belt is coarse, there are fine gaps defined between the belt and a recording sheet. At the time of charging by the corona electric charger, discharge occurs in these gaps, so that the electrostatic attraction force between the transfer belt and the sheet is weakened. FIGS. 23 and 24 respectively illustrate the states of surface roughness of two transfer belts in an enlarged scale. The transfer belt in FIG. 23 has a surface roughness Rmax of 6 μm, and the belt in FIG. 24 has a surface roughness Rmax of 4 μm. FIG. 25 graphically depicts evaluation results of transfer devices which employ the transfer belts having the above surface roughnesses. It is understood from FIG. 25 that in the transfer device utilizing the transfer belt with a surface roughness Rmax of 6 μm or less, the lap rate is high. It is therefore desirable to use a transfer belt having a surface roughness Rmax of 5 μm or less.

Although the preferred embodiments of this invention have been shown and described, it should be understood that the invention is not limited solely to these specific forms, but various modifications may be made to the described embodiments or the invention may be embodied in other forms without departing from the scope of the appended claims.

What is claimed is:

1. A belt-type transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said endless belt and the photosensitive body, said endless belt electrostatically attracting the recording medium, due to an electric charge by said means for electrically charging, carrying the recording medium to said region of contact, and transferring the toner image on the photosensitive body to the recording medium; and means for reducing the electric charge by said means for electrically charging in the vicinity of a terminal end of said region of contact, said means for reducing the electric charge comprises a shielding plate interposed between said endless belt and said means for electrically charging in the vicinity of said terminal end of said region of contact, said shielding plate extending from said terminal end of said region of contact toward a starting end thereof and means for increasing the electric charge by said means for electrically charging at said starting end and an intermediate portion of said region of contact.

2. A device according to claim 1, wherein said shielding plate is formed of a dielectric material.

3. A device according to claim 1, wherein said shielding plate is formed of an electrically conductive material.

4. A device according to claim 1, wherein said means for electrically charging comprises a corona discharge wire and a can surrounding said corona discharge wire, said corona discharge wire extends in a transverse direction of said endless belt, said can opens toward said region of contact to expose said corona discharge wire to said region of contact, said means for increasing the electrical charge comprises a film made of a dielectric material, and wherein said film is fixed to an entire length of an inner surface of said can, as measured along a length of the corona discharge wire.

5. A device according to claim 1, wherein said means for driving includes a plurality of members in contact with said endless belt for rotatably supporting said endless belt, and wherein said members in contact with said endless belt are grounded.

6. A device according to claim 5, wherein said means for driving includes a plurality of electrically conductive bearings, said members in contact with said endless belt are rotatably supported by said electrically conductive bearings to be grounded through said electrically conductive bearings.

7. A belt-type transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said endless belt and the photosensitive body, said endless belt electrostatically attracting the recording medium, due to an electric charge by said means for electrically charging, carrying the recording medium to said region of contact, and transferring the toner image on the photosensitive body to the recording medium; and means for reducing the electric charge by said means for electrically charging in the vicinity of a terminal end of said region of contact, said means for reducing-the electric charge reducing comprises a shielding plate interposed between said endless belt and said means for electrically charging in the vicinity of said terminal end of said region of contact, said shielding plate extending from said terminal end of said region of contact toward a starting end thereof, wherein said means for driving includes a plurality of members in contact with said endless belt for rotatably supporting said endless belt, said members in contact with said endless belt being grounded, wherein said means for driving further includes a plurality of plate pieces formed of an electrically conductive material, and wherein said members in contact with said endless belt are respectively in contact with said plate pieces to be grounded through said plate pieces.

8. A belt-type transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said belt and the photosensitive body, said belt electrostatically attracting the recording medium, due to an electric charge by said means for electrically charging, carrying the recording medium to said region of contact, and transferring the toner image on the photosensitive body to the recording medium; and means for reducing the electric charge by said means for electrically charging in the vicinity of a terminal end of said region of contact, and wherein said electrical charge reducing means comprises a position where said means for electrically charging is provided, and said position is set to be near an inlet of said region of contact with respect to a center of said region of contact between the photosensitive body and said endless belt in a stationary state.

9. A belt-type transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said endless belt and the photosensitive body, said endless belt electrostatically attracting the recording medium, due to an electric charge by said means for electrically charging, carrying the recording medium to said region of contact, and transferring the toner image on the photosensitive body to the recording medium; and means for reducing the electric charge by said means for electrically charging in the vicinity of a terminal end of said region of contact, said means for reducing the electric charge comprises a shielding plate interposed between said endless belt and said means for electrically charging in the vicinity of said terminal end of said region of contact, said shielding plate extending from said terminal end of said region of contact toward a starting end thereof, and wherein said endless belt has a surface roughness Rmax of 5 μm or less.

10. A belt-transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said belt and the photosensitive body, said belt electrostatically attracting the recording medium, due to an electric charge by said means for electrically charging, carrying the recording medium to said region of contact, and transferring the toner image on the photosensitive body to the recording medium;

means for reducing the electric charge by said means for electrically charging in a vicinity of a terminal end of said region of contact;

means for causing a constant value of a current to flow through said endless belt due to the electric charge by said means for electrically charging to stabilize the electric charge of said endless belt; and means for reducing a moving speed of the recording medium by 0.5% or less of a speed of the photosensitive body at least when the recording medium passes said region of contact, and wherein said means for electrically charging charges said endless belt by corona discharge, said means for electrically charging includes high voltage power source capable of controlling a current to be supplied for the corona discharge, said stability means for detecting a value of electric resistance of the recording medium and changes in density of the corona discharge by controlling said high-voltage power source in accordance with a moisture content of the recording medium represented by the value of electric resistance.

11. A belt-transfer device for an electrophotographic apparatus in which a toner image is formed on a photosensitive body and is electrostatically transferred and adhered to a recording medium, the device comprising:

an endless belt formed of an elastic material having a high electric resistance;

means for driving said endless belt for rotation, said endless belt being moved in contact with the photosensitive body over a certain distance;

means for electrically charging said endless belt in a region of contact between said belt and the photosensitive body, said belt electrostatically attracting the recording medium, due to an electric charge by said means for electrically charging, carrying the recording medium to said region of contact, and transferring the toner image on the photosensitive body to the recording medium;

means for reducing the electric charge by said means for electrically charging in a vicinity of a terminal end of said region of contact; and means for reducing a moving speed of the recording medium by 0.5% or less of a speed of the photosensitive body at least when the recording medium passes said region of contact.

12. A belt-type transfer device for an electrophotographic apparatus in which a toner image is formed on a rotating photosensitive body and is electrostatically transferred and adhered to a recording medium, the device comprising:

an endless belt formed of a dielectric elastic material;

means for driving said endless belt for rotation, said endless belt being moved through a transfer section, said endless belt being in contact with the photosensitive body over a certain distance at said transfer section;

corona electrical discharging means for electrically charging said endless belt at said transfer section, said endless belt electrostatically attracting said recording medium, due to an electrical charge by said corona electrical discharging means, carrying said recording medium to said transfer section and transferring the toner image on the photosensitive body to the recording medium; and means for reducing a moving speed of the recording medium to an extent lower than a rotational speed of the photosensitive body.

13. A device according to claim 12, wherein said means for reducing the moving speed of the recording medium reduces the speed of the recording medium by 0.5% or less of the speed of the photosensitive body.

14. A device according to claim 12, wherein said means for reducing the moving speed of the recording medium reduces a moving speed of said endless belt carrying the recording medium to an extent lower than the speed of the photosensitive body.

15. A device according to claim 12, wherein said means for reducing the moving speed of the recording medium reduces the speed of the recording medium to an extent slower than the speed of the photosensitive body when at least a leading edge of the recording medium passes said transfer section, and thereafter, said means for reducing the moving speed of the recording means returns the speed of the recording medium to a level equal to the speed of the photosensitive body.

16. A device according to claim 15, wherein said means for reducing the moving speed of the recording medium controls a moving speed of said endless belt carrying the recording medium.

17. A device according to claim 12, wherein said dielectric belt has a surface roughness Rmax of 5 μm or less.

18. An electrophotographic apparatus comprising:

a rotating photosensitive body;

means for forming an electrostatic latent image on said photosensitive body;

a developing device for visualizing the electrostatic latent image on said photosensitive body with a toner;

a belt-type transfer device including an endless belt, means for driving said endless belt for rotation in contact with said photosensitive body, and a corona electrical charger for electrically charging said endless belt in a region of contact between said endless belt and said photosensitive body, said endless belt electrostatically attracting a recording medium due to an electrical charge by said corona electrical charger to deliver the recording medium to the region of contact thereby transferring the toner image on said photosensitive body to the recording medium; and transportation means for feeding the recording medium to said belt-type transfer device, said transportation means having at least one delivery guide provided along a path of movement of the recording medium, said at least one delivery guide being formed of a material with a volume resistivity of $10^{11}$ Ωcm or less, and wherein said belt-type transfer device includes means for reducing a moving speed of the recording medium to an extent slower than a rotational speed of the photosensitive body.

19. An electrophotographic apparatus comprising:

a rotating photosensitive body;

means for forming an electrostatic latent image on said photosensitive body;

a developing device for visualizing the electrostatic latent image on said photosensitive body with a toner;

a belt-type transfer device including an endless belt, means for driving said endless belt for rotation in contact with said photosensitive body, a corona electrical charger for electrically charging said endless belt in a region of contact between said endless belt and said photosensitive body, and means for reducing the electrical charge by said corona electrical charger in a vicinity of a terminal end of said region of contact, said endless belt electrostatically attracting a recording medium due to the electrical charge by said corona electrical charger to deliver the recording medium to a region of contact thereby transferring the toner image on said photosensitive body to the recording medium; and transportation means for feeding the recording medium to said transfer device, said transportation means having at least one delivery guide provided along a path through which the recording medium moves prior to arriving at said transfer device, said guide being formed of a material with a volume resistivity of $10^{11}$ Ωcm or less.

20. An electrophotographic apparatus comprising:

a rotating photosensitive body;

means for forming an electrostatic latent image on said photosensitive body;

a developing device for visualizing the electrostatic latent image on said photosensitive body with a toner;

a belt-type transfer device including an endless belt, means for driving said endless belt for rotation in contact with said photosensitive body, a corona electrical charger for electrically charging said endless belt in a region of contact between said endless belt and said photosensitive body, and means for increasing the electrical charge by said corona electrical charger at a starting end and an intermediate portion of said region of contact, said endless belt electrostatically attracting a recording medium due to the electrical charge by said corona electrical charger to deliver the recording medium to a region of contact thereby transferring the toner image on said photosensitive body to the recording medium; and transportation means for feeding the recording medium to said transfer device, said transportation means having at least one delivery guide provided along a path through which the recording medium moves prior to arriving at said transfer device, said guide being formed of a material with a volume resistivity of $10^{11}$ Ωcm or less.

21. An electrophotographic apparatus comprising:

a rotating photosensitive body;

means for forming an electrostatic latent image on said photosensitive body;

a developing device for visualizing the electrostatic latent image on said photosensitive body with a toner;

a belt-type transfer device including an endless belt, means for driving said endless belt for rotation in contact with said photosensitive body, a corona electrical charger for electrically charging said endless belt in a region of contact between said endless belt and said photosensitive body, and means for causing a constant current to flow through said endless belt due to the electrical charge by said corona electrical charger to stabilize the electrical charge of said belt, said endless belt electrostatically attracting a recording medium due to the electrical charge by said corona electrical charger to deliver the recording medium to a region of contact thereby transferring the toner image on said photosensitive body to the recording medium; and transportation means for feeding the recording medium to said transfer device, said transportation means having at least one delivery guide provided along a path through which the recording medium moves prior to arriving at said transfer device, said guide being formed of a material with a volume resistivity of $10^{11}$ Ωcm or less.

22. An electrophotographic apparatus comprising:

a rotating photosensitive body;

means for forming an electrostatic latent image on said photosensitive body;

a developing device for visualizing the electrostatic latent image on said photosensitive body with a toner;

a belt-type transfer device including an endless belt, means for driving said endless belt having a surface roughness Rmax of 5 Ωm or less for rotation in contact with said photosensitive body, and a corona electrical charger for electrically charging said endless belt in a region of contact between said endless belt and said photosensitive body, said endless belt electrostatically attracting a recording medium due to the electrical charge by said corona electrical charger to deliver the recording medium to a region of contact thereby transferring the toner image on said photosensitive body to the recording medium; and transportation means for feeding the recording medium to said transfer device, said transportation means having at least one delivery guide provided along a path through which the recording medium moves prior to arriving at said transfer device, said guide being formed of a material with a volume resistivity of $10^{11}$ Ωcm or less.

* * * * *